United States Patent [19]

Yoshikawa et al.

[11] Patent Number: 4,924,267

[45] Date of Patent: May 8, 1990

[54] PROCESS CARTRIDGE AND MULTI-COLOR IMAGE FORMING APPARATUS USING SAME

[75] Inventors: Masao Yoshikawa, Tokyo; Takashi Saito, Yokohama; Tatuya Kobayashi, Yokohama; Otoya Kosugiyama, Yokohama; Atsushi Kubota, Machida; Tuyoshi Waragai, Tokyo; Tomoyuki Araki, Tokyo; Hiroo Kobayashi, Tokyo; Masahiko Yashiro, Tokyo; Hiroyuki Ishii, Yokohama, all of Japan

[73] Assignee: Canon Kabushiki Kaisha, Tokyo, Japan

[21] Appl. No.: 379,685

[22] Filed: Jul. 12, 1989

Related U.S. Application Data

[63] Continuation of Ser. No. 141,771, Jan. 11, 1988, abandoned.

[30] Foreign Application Priority Data

| | | | |
|---|---|---|---|
| Jan. 9, 1987 | [JP] | Japan | 62-003076 |
| Mar. 20, 1987 | [JP] | Japan | 62-066954 |
| Aug. 3, 1987 | [JP] | Japan | 62-194126 |
| Dec. 23, 1987 | [JP] | Japan | 62-326427 |

[51] Int. Cl.[5] ..... G03G 15/00

[52] U.S. Cl. ..... 355/210; 355/245

[58] Field of Search ..... 355/210, 245, 200, 4, 355/3 DR, 3 R, 3 DD

[56] References Cited

U.S. PATENT DOCUMENTS

| | | | |
|---|---|---|---|
| 4,286,861 | 9/1981 | Matsumoto et al. . | |
| 4,470,689 | 9/1984 | Nomura et al. | 355/3 DR |
| 4,500,195 | 2/1985 | Hosomo | 355/3 |
| 4,598,993 | 7/1986 | Mizutani et al. | 355/3 DR |
| 4,605,299 | 8/1986 | Mochimaru | 355/3 DR |
| 4,607,941 | 8/1986 | Honda | 355/3 DR |

FOREIGN PATENT DOCUMENTS

| | | |
|---|---|---|
| 3329714 | 2/1984 | Fed. Rep. of Germany . |
| 104951 | 6/1982 | Japan . |
| 33472 | 2/1984 | Japan . |
| 59-61859 | 9/1984 | Japan . |
| 173565 | 9/1985 | Japan . |
| 134654 | 6/1987 | Japan . |
| 2127744 | 4/1984 | United Kingdom . |

*Primary Examiner*—R. L. Moses

*Attorney, Agent, or Firm*—Fitzpatrick, Cella, Harper & Scinto

[57] ABSTRACT

An image forming apparatus usable with a process cartridge detachably mountable thereto. The process cartridge includes a main cartridge containing a photosensitive member and process means as a unit. A subordinate process cartridge is detachably mountable to the main cartridge. The subordinate cartridge includes at least a developing device which is different from the developing device contained in the main cartridge so that a multi-color image can be formed if desired. The photosensitive member is used both for the main process cartridge and the subordinate cartridge.

39 Claims, 17 Drawing Sheets

PROCESS CARTRIDGE AND MULTI-COLOR IMAGE FORMING APPARATUS USING SAME

This application is a continuation of application Ser. No. 141,771 filed 01/11/88, now abandoned.

FIELD OF THE INVENTION AND RELATED ART

The present invention relates to an image forming technique using an electrophotographic process, more particularly to a technique wherein a process cartridge which is detachably mountable into a main assembly is used, and a multi-color image is formed using the process cartridge.

Recently, an electrostatic recording system using an electrophotographic process has become widely used as a printer for a terminal of information apparatus such as computers, facsimile machines and CADs.

In such a printer, an information signal is written on an electrostatic latent image bearing member, more particularly a photosensitive member with a laser beam, LED (light emitting diode) and LCD (liquid crystal device), and is visualized by a developing device, whereafter the visualized image is transferred onto a transfer sheet and then is fixed, whereby the recorded image is produced. However, the conventional printers can provide only a monochromatic image (black, for example) recorded.

More recent trend is toward two or more color image recording to make the recorded image clearer and to make it more understandable. For example, a format and the data are recorded in different colors; or a part of the drawing outputted from CAD is recorded in a different color.

An example of an electrophotographic apparatus capable of performing two color image recording is shown in FIG. 5.

The apparatus comprises an electrophotographic photosensitive member 201 in the form of a drum which is rotatable and which includes a conductive base member and a photoconductive layer thereon. The photosensitive drum 201 is uniformly charged by a charger 202, and then is exposed to a first information signal beam 203 by a light emitting element such as a laser to form a first electrostatic latent image, which is visualized by a first developing device 204. Subsequently, the photosensitive drum 201 is charged again by a charger 205 and is exposed to a second information signal beam 206 by a light emitting element such as a laser to form a second latent image, which is then visualized by a second developing device 207. The visualized images are transferred onto a transfer sheet 209 and is then fixed by a fixing device 210. The toner remaining on the photosensitive drum 201 after the image transfer is removed by a cleaning device 211.

In such a type of electrophotographic apparatus, expert servicemen are prepared for the purpose of maintenance operation after long term use of the apparatus (such as exchange of the photosensitive member, replenishment of the developer, the cleaning of the charging wire and other adjustment and exchange). However, a proposal has been made to make the maintenance operations possible without the expert servicemen to maintain the apparatus under good conditions.

As an example, there is a method wherein a plurality of process means such as a charger, a developing device and a photosensitive drum are combined as a unit into a cartridge, which is simply exchanged with a new cartridge. In this system where the process cartridge is exchangeable, the process cartridge can be simply exchanged with new one for the purpose of maintenance, repair and exchange of consumable parts, by which the apparatus can be immediately put back to the operable condition.

However, in a multi-color print electrophotographic apparatus, consumptions of different color toners are different, with the result that if the developing devices for the different color developers, respectively, are contained in the same process cartridge, the service life of the process cartridge itself is significantly reduced in view of the fact that only one of the toners is used up earlier than the other.

Additionally, the users ordinarily print in only one color such as black, and non-black image is used only on special occasions, so that the necessity of buying a number of process cartridges each containing the black toner and a different non-black toner will impose significant economical charges on such users.

To obviate this problem, it would be possible to make only the developing device detachably mountable to allow exchange of the developing device. However, the property of the developer is different depending on the material of the toner alone, for example, with the result that in order to provide the proper operation of the developing device, it is necessary to make the latent image condition as well as the developing condition match developing device. However, in the method wherein only the developing device is exchanged, it is not possible to change the latent image condition. For example, when the developing device is exchanged for the exchange of the color of the toner, a proper image can not be formed, which is a problem.

SUMMARY OF THE INVENTION

Accordingly, it is a principal object of the present invention to provide a process cartridge and a multi-color image forming apparatus using the same in which manipulation is easy.

It is another object of the present invention to provide a printer by which an image can be produced in plural colors using a process cartridge.

It is a further object of the present invention to provide a positioning mechanism for properly attaching a subordinate process cartridge to a main process cartridge.

According to an embodiment of the present invention, there is provided a process cartridge usable with a multi-color image forming apparatus comprising a main process cartridge containing an electrophotographic photosensitive member and a first developing device containing first color toner as a unit and a subordinate process cartridge which is detachably mountable to the main process cartridge and which contains a second developing device containing second color developer which is different from the first color developer. Those main and subordinate process cartridge are integral at least when the image forming operation is performed in the main assembly of the apparatus.

The image forming apparatus used with the main process cartridge only, that is, without the subordinate cartridge, is capable of producing an image developed only by the developing device of the main cartridge. On the other hand, when the subordinate cartridge is loaded, a multi-color image is produced which has been developed by the developing devices of the main and subordinate cartridges.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

First, the description will be made with respect to the relationship between the main process cartridge and subordinate process cartridge.

Figure 1:
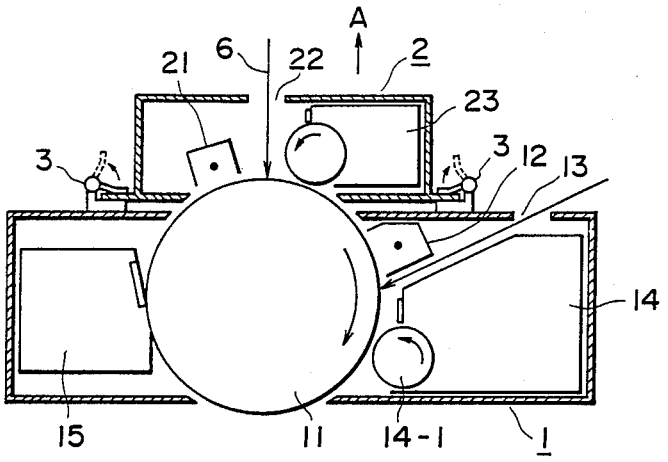
FIG. 1 is a longitudinal cross-sectional view of a process cartridge according to an embodiment of the present invention.

Referring to FIG. 1, there is shown a process cartridge according to an embodiment of the present invention in a longitudinal section. The process cartridge 1 contains a photosensitive drum 11 rotatable in the clockwise direction as viewed in FIG. 1, a charger 12, an exposure window 13, a developing device 14 and a cleaning device 15 as a unit. A subordinate process cartridge 2 contains a charger 21, an exposure window 22 and a developing device 23 as a unit. The subordinate cartridge 2 is mounted to the main process cartridge 1 by a fixing member 3. When the subordinate cartridge is fixed thereby, the positional interrelation between the photosensitive drum 11 and charger 21 and the developing device 23 is fixed at a predetermined.

By releasing the fixing member 3, the subordinate cartridge 2 can be dismounted from the process cartridge 1 in the direction indicated by an arrow A, that is, upwardly in FIG. 1.

The subordinate cartridge 2 may contain a developing device 23 containing any color developer, and since properties of the toners such as charging properties are different, a latent image forming condition and a developing condition are properly set for the respective color toners in order to provide proper images for the respective colors, if necessary. As for a method of changing the latent image forming condition, a shape of the charger 21 and/or a distance between the charging wire and the photosensitive drum 11 may be changed, and in addition, when a scorotron is used as the charger, the rated voltage or the like of a constant voltage element connected to a grid of the scorotron may be changed to a proper level. As for a method of changing the developing condition, a bias voltage from the power source contained in the main assembly of the image forming apparatus is changed to a proper level by a circuit containing a resistor or resistors and a capacitor or capacitors in combination. By constructing this way, a stabilized and good quality images can be produced irrespective of which one of the subordinate cartridge is used.

Figure 2:
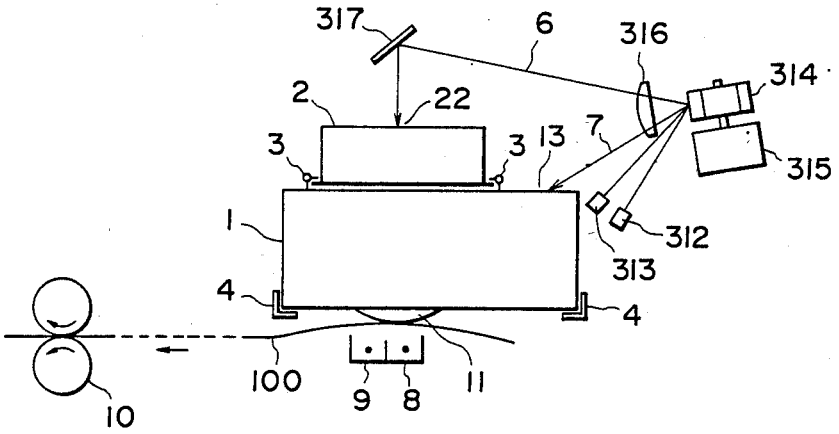
FIG. 2 is a schematic view illustrating operation of FIG. 1 cartridge.

The process cartridge 1 having the above described construction, with the subordinate cartridge 2 mounted thereto, is guided by a guide 4 of the main assembly as shown in FIG. 2, to be mounted into the main assembly. FIG. 2 illustrates the process cartridge 1 mounted into the main assembly, wherein frames or the like of the main assembly are omitted for the sake of simplicity.

Referring to FIGS. 1 and 2, the description will be made as to the operation of the apparatus when the process cartridge is mounted in the main assembly.

The photosensitive drum 11 having an electrophotographic photosensitive member of an organic photoconductor material is uniformly charged to a negative polarity by a first charger 21 contained in the subordinate cartridge 2, and then is exposed to first image light 6 such as a format or the like through the exposure window 22. In this embodiment, the first image light 6 is a first laser beam produced and modulated by a first image signal by a first semiconductor laser source 312. The first laser beam is deflected by a rotational mirror 314 such as a rotary polygonal mirror rotating at a constant angular velocity by a motor 315. The laser beam is passed through an imaging lens 316 and is reflected by a mirror 317, and then is projected onto the photosensitive drum 11 to scan it, whereby a first electrostatic latent image is formed.

The exposure optical system is built in an main assembly.

The first electrostatic latent image is developed by a first developing device 23 contained in the subordinate cartridge 2. The developing device 23 contains a developer comprising magnetic particles and non-magnetic toner particles having a chromatic color such as red, and is effective to develop the first electrostatic latent image in the chromatic color to form a first toner image.

Subsequently, the photosensitive drum 11 is again uniformly charged to the negative polarity by the second charger 12 contained in the main process cartridge 1 and is exposed to a second image light (signal) 7 such as data through the exposure window 13. The second image light 7 is a second laser beam produced and modulated in accordance with the second image signal by a second semiconductor laser source 52. The second laser beam is deflected by the rotary (polygonal) mirror 314 and is passed through the imaging lens 316 to raster-scan the photosensitive drum 11, whereby a second electrostatic latent image is formed.

The second electrostatic latent image is developed by a second developing device 14 contained in the process cartridge 1. In the developing device 14, a black one component magnetic toner particles are formed into a thin developer layer on the developing sleeve 14-1, which is not contacted to the photosensitive drum 11 but is caused to jump thereto, in this embodiment, the developing device 14 develops the second electrostatic latent image in black to form a second toner image.

The two color toner image thus produced is simultaneously transferred onto a transfer sheet 100 by a transfer device 8 contained in the main assembly; and then, the transfer sheet 100 is separated from the photosensitive drum 11 by a separating device 9 and is transported to a fixing device 10 where the transferred toner image is fixed.

When the process cartridge 1 and the mountable subordinate cartridge 2 described above are used, the black image is formed by the process cartridge side, whereas the chromatic color image is formed at the subordinate cartridge side. Generally, the printing is most frequently effected in black, and therefore, the toner loading capacity of the developing device 14 in the process cartridge 1 is preferably larger than that of the developing device 23 in the subordinate cartridge 2.

The process means such as the developing device and the corona discharging device mounted as a unit in the process cartridges 1 and 2 are not limited to those described above. For example, it may be a developing device using a magnet roller only. With respect to the charging device, it may be a bias electrode. Those process means may be of any known type. This will apply also to the following embodiments.

Figure 3:
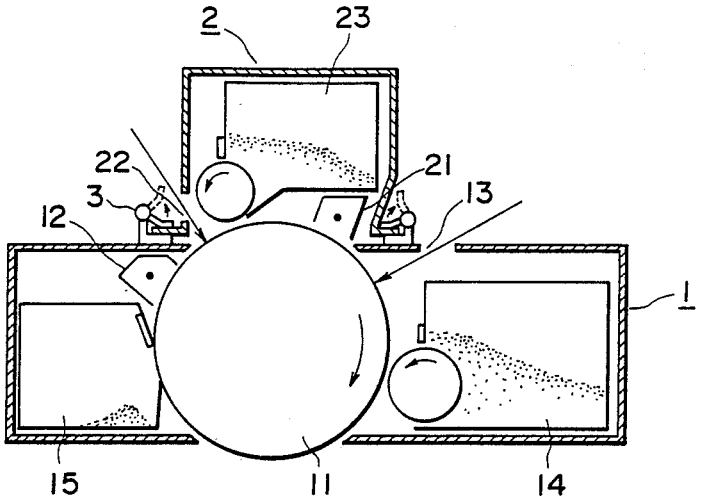
FIGS. 3 and 4 are longitudinal sectional views of the process cartridges according to other embodiments of the present invention.
Figure 4:
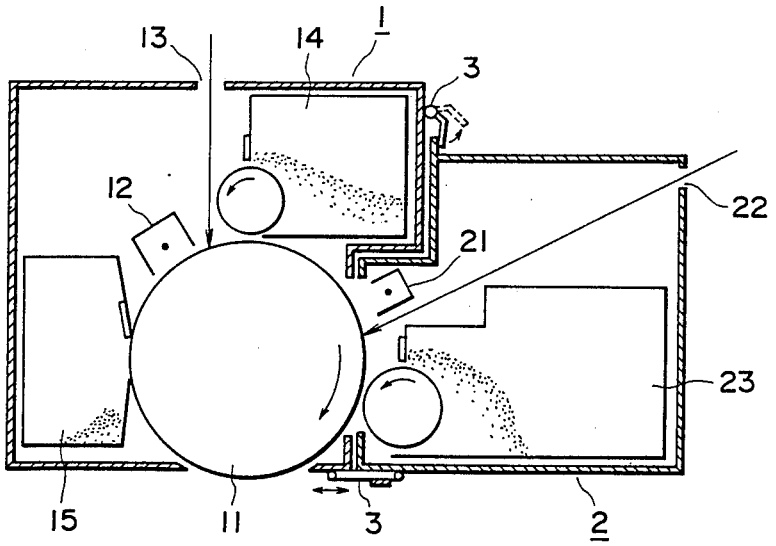
Figure 5:
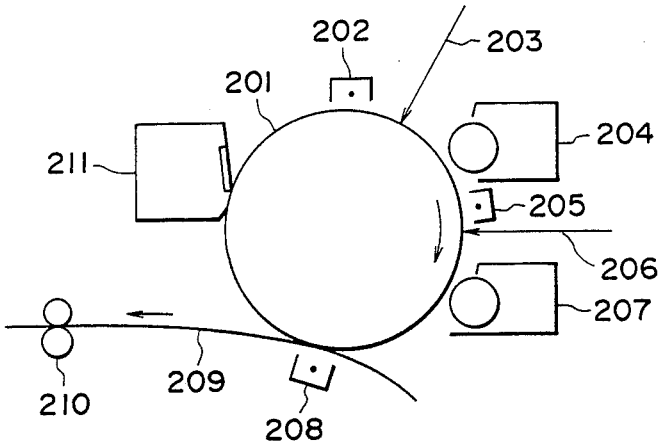
FIG. 5 is a schematic view illustrating an example of an electrophotographic apparatus capable of forming a two-color image.

FIGS. 3 and 4 show other embodiments. In FIG. 3, the first charging device 12 is contained in the process cartridge 1, whereas the second charging device 21 is contained in the subordinate cartridge 2. In FIG. 4, the first charging device 12 and the first developing device 14 are contained in the process cartridge 1, whereas the second charging device 21 and the second developing device 23 are contained in the subordinate cartridge 2.

In either embodiment, if one of the developing device becomes empty, the process cartridge and the subordinate cartridge are separated, and the proper one is exchanged with new one, whereby the printing becomes possible again.

Since the process cartridge itself is provided with the charger, the exposure window and the developing device, it is possible to use the process cartridge alone without use of the subordinate cartridge when two-color print is not required.

In the foregoing description of the embodiment, the means for fixing the subordinate cartridge to the main cartridge (process cartridge) is not described in detail. However, as shown in the Figure, it may include a hinge movable between a releasing position and a fixing position. Other fixing means will be described hereinafter.

Next, the description will be made as to an automatic change of the image forming condition depending on presence and absence of the subordinate cartridge.

Figure 6:
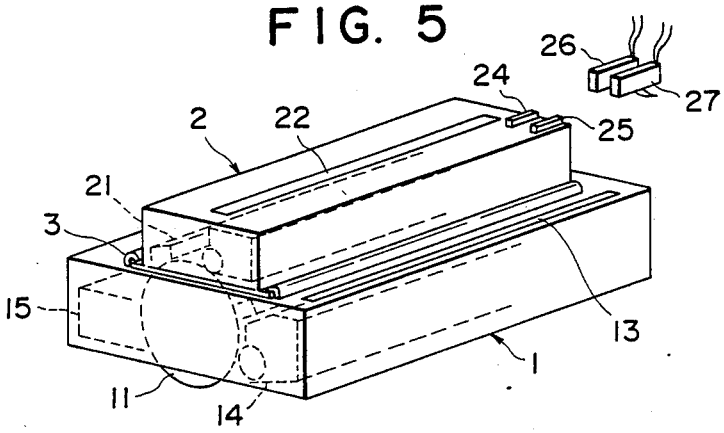
FIG. 6 is a perspective view of a main part of a multi image forming apparatus according to an embodiment of the present invention.
Figure 7:
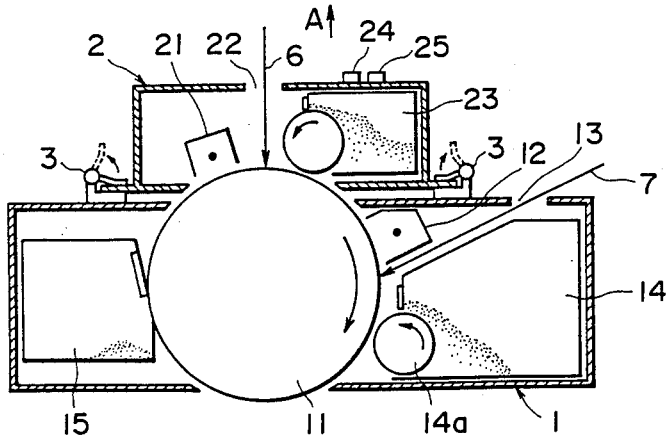
FIG. 7 is a longitudinal cross-sectional view of FIG. 6 apparatus.

FIGS. 6 and 7 illustrate a first example by which the image forming condition is automatically changed depending on the presence and absence of the subordinate cartridge. The process cartridge 1 contains a photosensitive drum 11 as an image bearing member, a charger 12, an exposure window 13, a developing device 14 and a cleaner 15 as a unit. A subordinate cartridge 2 contains a charger 21, an exposure window 22 and a developing device 23 as a unit. The subordinate cartridge 2 is mounted to the process cartridge 1 by a mounting member 3. When the subordinate cartridge 2 is mounted to the process cartridge 1 by the fixing means, the positional relationship between the charger 21 and the developing device 23 and the photosensitive drum 11 are established to be predetermined relations. When the fixing member 3 is released, the subordinate cartridge 2 is dismounted from the process cartridge 1 in the direction indicated by an arrow A, that is, upwardly in the Figure.

The cartridges 1 and 2 of this embodiment are mounted in use into the main assembly in the same manner as described with FIG. 2.

Figure 8:
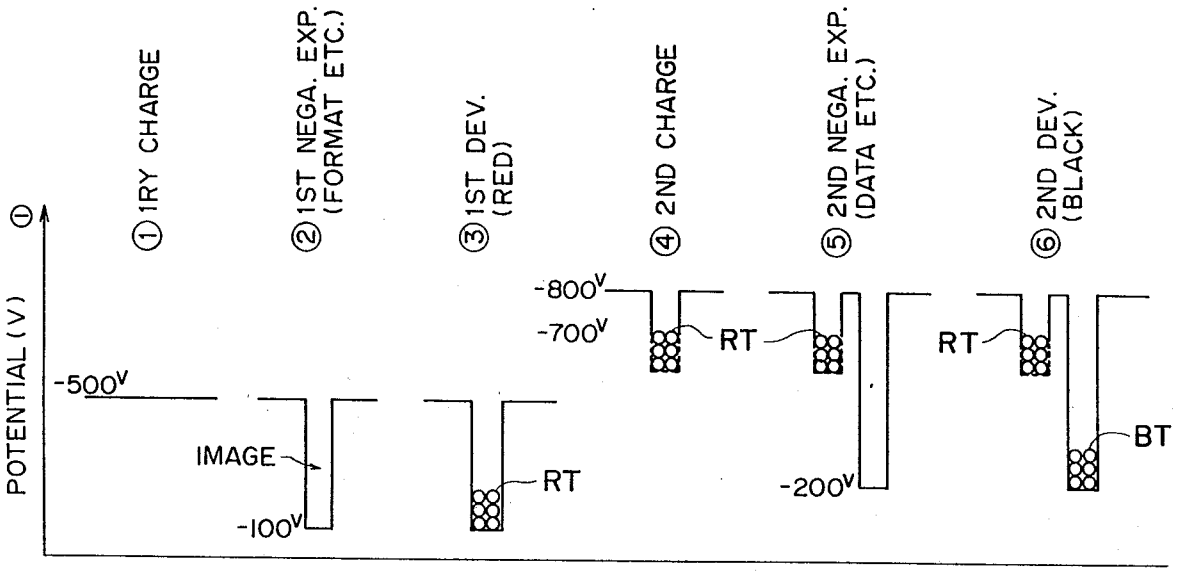
FIG. 8 is a diagram illustrating an image forming process.

Referring to FIG. 8, the image forming process will be described.

The photosensitive drum 11 having a photosensitive layer (organic photoconductor) is uniformly charged to approximately −500 V by a first charger 21 contained in the subordinate cartridge 2. Subsequently, the photosensitive drum 11 is exposed to a first image light 6 such as a format through the exposure window 2. The first image light 6 is a first laser beam produced and modulated in accordance with a first image signal by a first semiconductor laser 51. The first laser beam is deflected by a rotary mirror such as a rotary polygonal mirror rotating at a constant angular velocity by a motor 54 and is projected onto the photosensitive drum 11 after being passed through an imaging lens 55 and reflected by a mirror 56, thereby to raster-scan the photosensitive drum 11, by which a first electrostatic latent image is formed thereon. The exposure optical system is built in the main assembly.

The first electrostatic latent image is developed by a first developing device 23 contained in the subordinate cartridge 2. The developing device 23 contains a developer including magnetic particles and chromatic toner particles RD such as red toner particles. The developing device 23 forms a first toner image from the first electrostatic latent image in a chromatic color by a reversal development.

Subsequently, the photosensitive drum 11 is again uniformly charged to a negative polarity by a second charger 12 contained in the process cartridge 1. Here, the charging is effected such that the potential of the already formed toner image (by toner RD) becomes −700 V. By setting in this manner, the potential of the non-image-area can be limited to approximately −800

V, and therefore, the photosensitive drum 11 is not damaged by over-charging.

Then, the photosensitive drum 11 is exposed through the exposure window 13 to a second image signal 7 such as data. The exposure is a negative exposure, and the exposed portion is attenuated down to −200 V. The second image light 7 is a second laser beam produced and modulated in accordance with the second image signal by a second semiconductor laser source 52. The second laser beam is deflected by a rotary mirror such as rotary polygonal mirror 53. The laser beam is projected through the imaging lens 55 onto the photosensitive drum 11 to raster-scan the photosensitive drum 11 to form a second electrostatic latent image.

The second electrostatic latent image is developed by a second developing device 14 contained in the process cartridge 1. Since the potential of the first toner image has been increased by the second charger 12, only the second electrostatic latent image is developed by the second developing device 14. In the developing device 14, black one component magnetic toner particles BT are formed into a thin layer on a developing sleeve 14*a*, and the toner particles are not contacted to the photosensitive drum 11 but they jump to the photosensitive drum 11. The second electrostatic latent image is developed in black to provide a second toner (BT) image.

The two-color toner image thus formed is simultaneously transferred onto a transfer sheet P by a transfer device 8 contained in the main assembly. The transfer sheet P is separated from the photosensitive drum 11 by a separating device 9 and is conveyed to an image fixing device 10 where the toner image is fixed.

As described, it is necessary in order to prevent color mixture in the resultant image to increase the potential of the first toner image by the second charger 12. Here, it is highly preferable in order to prevent the damage to the drum and to sufficiently maintain the latent image contrast in the second latent image formation that the charging condition is set such that the toner image portion potential is approximately −700 V, whereas the non-toner-image portion is approximately −800 V. Generally, it is highly preferable that the toner-image portion potential $V_T$ satisfies $-500 \leqq V_T \leqq -900$, and the non-toner-image portion potential $V_I$ is no greater than −1000 V (absolute value), in order to satisfy the above-described conditions.

However, when with those conditions set, a monochromatic printing is effected with the use of the process cartridge 1 without the use of the subordinate cartridge 2, only the second charger 12 is usable as for the charging means. With the conditions of the second charging device 12 set in the manner described above, the charging is not sufficient, therefore it is required that the voltage applied to the second charger 12 is increased. Further, the developing condition is required to be set to match the formed latent image.

According to this invention, a signal source is provided to switch an image forming condition such as a latent image forming condition and/or a developing condition of the process cartridge 1 between when the subordinate cartridge is mounted to the process cartridge 1 and when it is not mounted.

As for the signal source, FIG. 6 shows an example wherein a couple of projections 24 and 25 are formed adjacent an end of a subordinate cartridge 2. Correspondingly, the main assembly is provided with a latent image forming condition changing switch 26 and a developing condition changing switch 27 to be actuated by the projections 24 and 25, respectively. By the mounting and dismounting of the subordinate cartridge 2, the switches 26 and 27 are actuated so as to switch the latent image forming condition and/or the developing condition.

Figure 9:
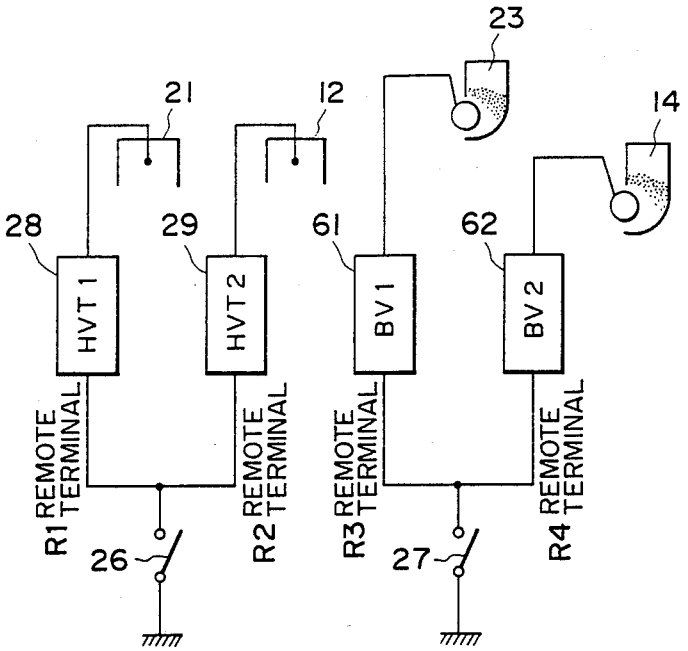
FIG. 9 is a block diagram of a control system for switching an image forming condition.

FIG. 9 shows a control block for switching the latent image forming condition and/or the developing condition, which contains high voltage sources (HVT1, HVT2) 28 and 29, developing bias sources (BV1, BV2) 61 and 62. When an input voltages to remote terminals R1, R2, R3 and R4 become 0 V, the high voltage sources 28 and 29 (HVT1, HVT2) and the developing bias sources 61 and 62 (BV1, BV2) produce different voltages, which are applied to the first charger 21, the second charger 12, the first developing device 23 and the second developing device 14.

For example, when the subordinate cartridge 2 is mounted into the main assembly together with the process cartridge 1 so that the projections 24 and 25 actuate the switches 26 and 27, the first charger is supplied with −6.0 KV, whereas the second charger 12 is supplied with −5.0 KV, in order to provide the above described charge potentials; the first developing device 23 is supplied with a bias voltage provided by superposed AC voltage having a frequency of 1600 Hz and a peak-to-peak voltage of 1800 Vp-p and a DC voltage of −400 V, and the second developing device 14 is supplied with a bias voltage provided by superimposed AC voltage having a frequency of 1600 Hz and a voltage of 1000 Vp-p and a DC voltage of −650 V. Under those conditions, the above-described image forming process is executed.

On the other hand, when the process cartridge 1 is mounted in the main assembly without the subordinate cartridge 2 so that the switches 26 and 27 are not actuated, the voltage supplied to the second charger 12 is increased up to −6.4 KV to provide a charged potential of −600 V; the second developing device 14 is supplied with a bias voltage provided by superposed AC voltage having a frequency of 1600 Hz and a peak-to-peak voltage of 1000 Vp-p and a DC voltage of −550 V; and the image forming operation is performed. In this state, no voltage is supplied to the first charge 21 or to the first developing device 23.

As described above, by the provision of the subordinate cartridge 2 with a signal source for setting the image forming condition, it is now possible to changing the latent image forming condition and/or the developing condition of the process cartridge 1 depending on whether the subordinate cartridge 2 is mounted or dismounted, and therefore, it is possible to perform a desirable image forming operation irrespective of whether the subordinate cartridge 2 is used or not.

In the foregoing example, the latent image forming condition changing switch 26 and the developing condition changing switch 27 are provided in the main assembly, whereas projections 24 and 25 for actuating the respective switches 26 and 27 are provided in the subordinate cartridge 2; however, it is a possible alternative to provide projections 24 and 25 in the main assembly and to provide the switches 26 and 27 in the subordinate cartridge 2. Also, it is a possible alternative that only one switch is used commonly for changing the latent image forming condition and the developing condition.

Figure 10:
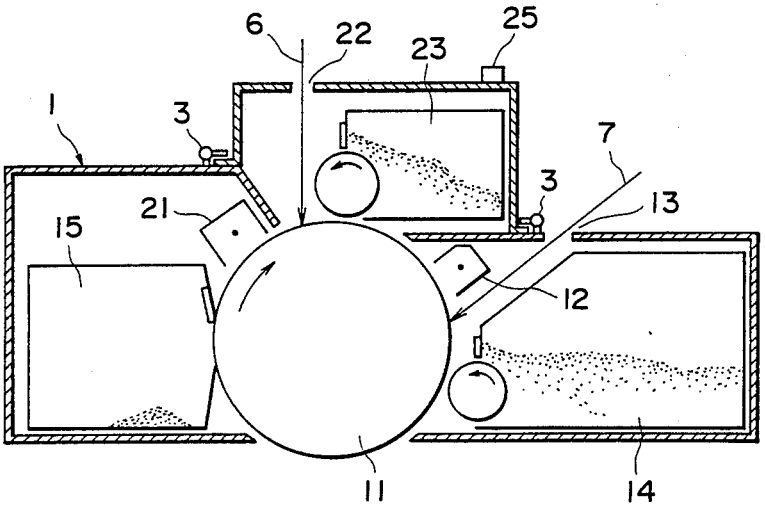
FIG. 10 is a longitudinal sectional view of a main part according to another embodiment of the present invention.

FIG. 10 shows a second embodiment, wherein the first charger 21 in the first embodiment is contained in the process cartridge 1, and the first developing device 23 only is contained in the subordinate cartridge 2. The other structures are similar to the example of FIGS. 6 and 7.

With this structure, the charge potential is the same irrespective of whether the subordinate cartridge 2 is mounted or dismounted. However, between when the subordinate cartridge 2 is mounted so that two developing devices are operated and when the subordinate cartridge 2 is not mounted so that only one developing device is operated, the load imposed on the bias voltage supplying source of the main apparatus is different, which necessiates to change the voltage level of the bias voltage supplying source for the second developing device 14. In order to meet this necessity, a projection 25 is formed adjacent an end of the subordinate cartridge 2 in the example of FIG. 10 to actuate the developing condition changing switch 27 (FIG. 9) in the main assembly. By the switch 27, the output from the bias voltage supplying source applied to the second developing device 14 is changed to be proper levels depending on whether the subordinate cartridge 2 is mounted or dismounted. In this embodiment, the latent image forming condition may be changed if necessary in the same manner as described with FIG. 7 embodiment.

Further, the description will be made as to another example of automatic setting of the image forming condition in the structures of the main and subordinate cartridges similar to those of FIG. 10.

Figure 11:
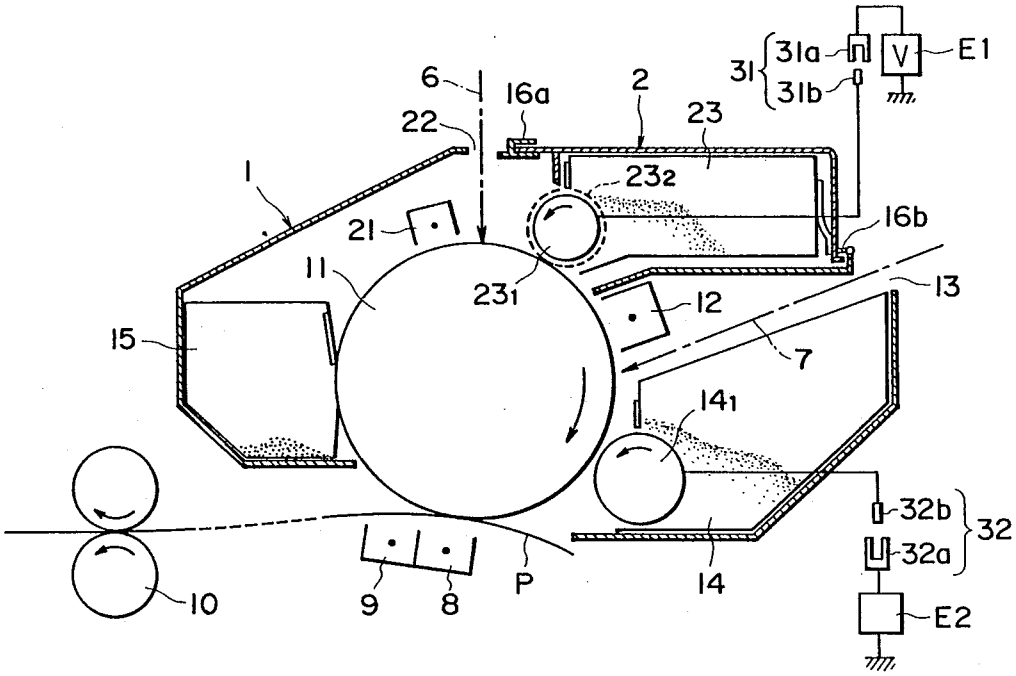
FIG. 11 is a longitudinal cross-sectional view of a process cartridge according to an embodiment of the present invention.

Referring to FIG. 11, when the subordinate cartridge 2 is mounted to the main cartridge 1, the positional relation between the photosensitive drum 11 and the first developing device 13 contained in the subordinate cartridge 2 is made to satisfy predetermined conditions. For example, a distance between the photosensitive drum 11 and a developer carrying member $23_1$ such as a developing sleeve or the like is always maintained at a predetermined by abutting abutment members $23_2$ provided at opposite ends of the developer carrying member $23_1$ to a periphery of the photosensitive drum 11. A spring $23_3$ is effective to abut the abutment members $23_2$ to the periphery of the photosensitive drum 1 at a proper pressure.

Figure 13:
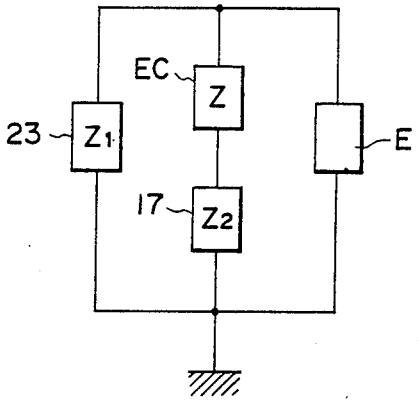
FIG. 13 shows a circuit for a developing bias voltage.

As shown in FIG. 13, voltage sources E1 and E2 supply bias voltages to the first and second developing devices 23 and 14, respectively. They are connected to the developer carrying member $23_1$ and $14_1$ of the developing devices 23 and 14 by connectors 31 and 32. Contacts 31*a*, 31*b*, 32*a* and 32*b* of the connectors 31 and 32 are provided on a side wall of the respective cartridges 2 and 1 and provided on the main assembly corresponding to the associated connectors, respectively, so that by mounting the cartridges 2 and 1 into the main apparatus, they are automatically contacted. A transfer charger 10 and an image fixing device 10 are provided in the main assembly in this embodiment.

In operation, the photosensitive drum 1 having an organic photoconductor layer as a photosensitive layer is uniformly charged by a first charger 21 to a negative polarity, for example to −600 V, and is exposed to a first image light beam 6 such as a format through an exposure window 22 so as to provide −100 V as an exposed part potential.

A first electrostatic latent image thus formed is developed by a first color toner contained in the first developing device 24. The first developing device 23 is of a magnetic brush type using two component developer containing magnetic particles such as ferrite and chromatic toner particles (red, for example). To the first developing device 23, a developing bias voltage is applied from the power source E1 of the main assembly through the connector 31. The developing bias voltage is for example a superposed voltage of an AC voltage having a frequency of 1600 Hz and a peak-to-peak voltage of 1800 Vp-p and a DC voltage of −500 V.

Next, the photosensitive drum 11 is again uniformly charged to a negative polarity by the second charger 12, by which the potential of the toner image formed by the first developing device 23 is increased up to −600 V. Subsequently, the photosensitive drum 11 is exposed to a second image light beam 7 such as data through the exposure window 13. The second image light 7 raster-scans the photosensitive drum 11 in the same manner as of the first image light beam 6, to form a second electrostatic latent image.

The second electrostatic latent image is developed by the second developing device 14 with black toner, for example. The developing device 14 is of a non-contact type such as disclosed in Japanese Laid-Open Patent Application 18659/1980, using one component magnetic toner. To the developing device 14, a developing bias is applied from the voltage source E2 of the main assembly through the connector 32. The developing bias is provided as a superposed voltage of an AC voltage having a frequency of 1600 Hz and a peak-to-peak voltage of 1100 Vp-p and a DC voltage of −550 V.

In this manner, two color toner image is formed on the photosensitive drum 11 in accordance with different pieces of image information, and the toner image is simultaneously transferred onto a transfer sheet P by a transfer charger 8.

One of the first developing device 23 and the second developing device 14 becomes empty, the subordinate cartridge 2 is dismounted from the main cartridge 1, and the cartridge containing the empty developing device is exchanged with a fresh cartridge. By this, the remaining cartridge can be used until the toner therein is used up, and therefore, the function of performing two color print can always be maintained without wasteful toner.

In this embodiment, the developing device 14 of the main cartridge 1 contains the black toner which is relatively frequently used, and the amount of the toner contained in the developing device 14 is matched to the service life of the photosensitive drum 11. This is preferable for a general use from economical and operational standpoint.

Figure 12:
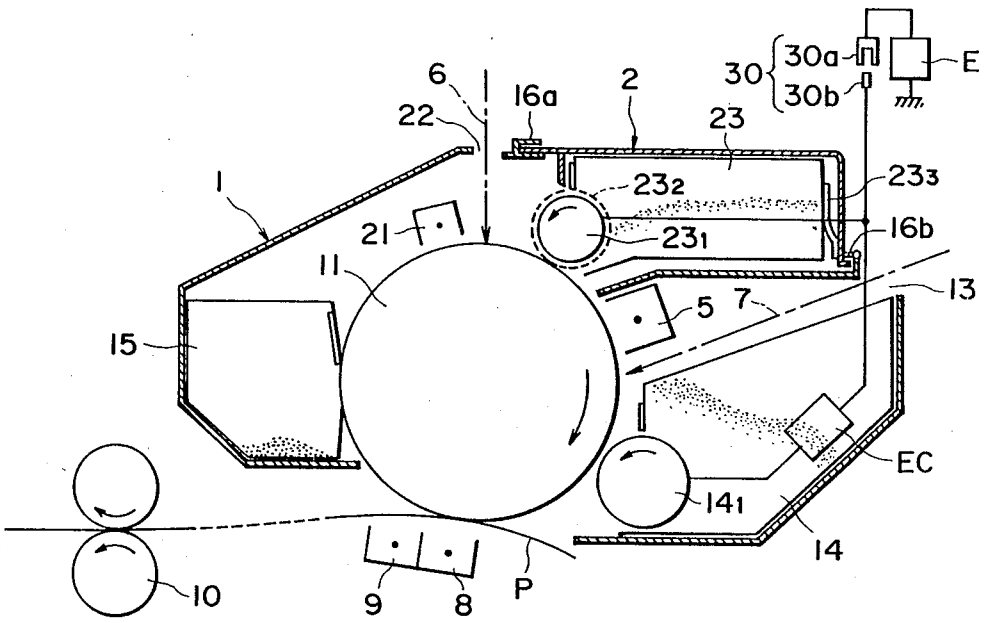
FIG. 12 is a longitudinal cross-sectional view of a process cartridge according to an embodiment of the present invention.

Referring to FIG. 12, there is shown a further embodiment, wherein the voltage source E for the first developing device 23 an for the second developing device 14 and a connector 30 are common to the developing devices 23 and 14. The other structures are similar to the foregoing embodiment.

According to this structure, only one bias voltage source E and only one connector are satisfactory, and therefore this is preferable from an economical standpoint. In this case, the connector 30 is constructed such that by the operation of mounting the main cartridge 1 into the main assembly, the contacts 30*a* and 30*b* of the connector 30 are automatically connected as in the case of FIG. 11. The first developing device 23 of the subordinate cartridge 2 is connected to the voltage source E by, for example, the subordinate cartridge 2 being loaded into the main cartridge 1.

In many cases, the conditions of the developing biases applied to the first developing device 23 and the second developing device 14 are different. It is possible in such a case that the developing bias is applied to one of the developing devices through an impedance circuit EC comprising a resistor element, a capacitor element, a coil element or a combination thereof.

When, for example, the first developing device 23 is supplied with a bias voltage provided by superposing an AC voltage having a frequency of 1600 Hz and a peak-to-peak voltage of 1800 Vp-p and a DC voltage of −500 V, whereas the second developing device 14 supplied with a bias voltage provided by superposing an AC voltage having a frequency of 1600 Hz and a peak-to-peak voltage of 1100 Vp-p, the bias voltage is applied to the second developing device 14 through an impedance circuit EC as shown in FIG. 12, whereas the other developing device that is the first developing device is supplied directly from the voltage source E. In this case, the conditions of the voltage source E is matched to the developing bias condition of the first developing device.

The description will be made as to the structure of an impedance circuit EC.

FIG. 13 illustrates an equivalent circuit in the case that the first developing device 23 has an impedance Z1, and the second developing device 14 has an impedance Z2.

To the first developing device 23, an output voltage V of the developing bias source E is applied, which is, for example, a bias voltage provided by superposing an AC voltage having a frequency of 1600 Hz and a peak-to-peak voltage of 1800 Vp-p and a DC voltage of −500 V.

Figure 14:
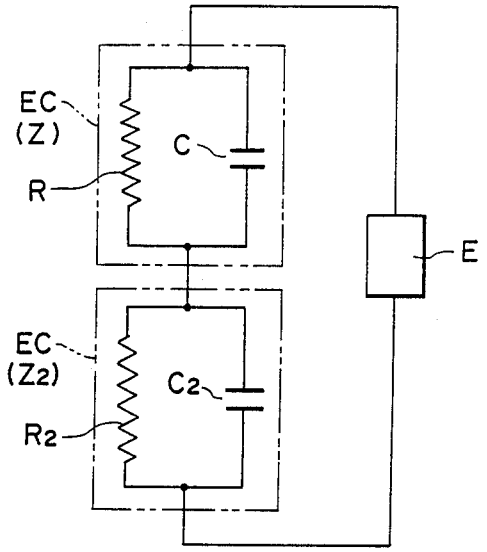
FIG. 14 shows an impedance circuit.

On the other hand, to the second developing device 14, an impedance circuit EC having an impedance Z is connected in series, and therefore $$V2=Z2\cdot V/(Z+Z2) \quad (1)$$

is applied to the second developing device 14. Generally, a developing device is expressed electrically as an equivalent circuit comprising a capacitor and a resistor. An equivalent circuit for the developing bias applied to the second developing device 14 is shown in FIG. 14.

The second developing device 14 having the impedance Z2 is expressed as a parallel connection circuit of an electrostatic capacitor C2 and a resistor R2. A parallel connection circuit comprising an electrostatic capacitor C and a resistance R is connected, as an impedance circuit EC having an impedance Z, in series with the voltage source E and the second developing device 14.

Here, $$Z=R/\sqrt{1+\omega^2R^2C^2} \quad (2)$$

$$Z2=R/\sqrt{1+\omega^2R2^2C2^2} \quad (3)$$

($\omega=2\pi f$, where f is a frequency of the voltage source).

In the second developing device 14 used in this embodiment, R2 was 1000 MΩ, C2 was 120 pF. Therefore, for an AC component (f=1600 Hz) of the developing bias voltage V, the following results from equations (3) and (2).

$Z2=1/\omega C2$ (because $\omega^2R^2C2^2$ is sufficiently larger than 1).

$Z=1/\omega C$ (because $W^2R^2C^2$ is sufficiently larger than 1).

Therefore, the AC component $V2_{AC}$ of the bias voltage V2 of the second developing device is, from equation (1):

$$V2_{AC}=Z2V/(Z+Z2)=CV_{AC}/(C+C2) \quad (4)$$

In order to set $V2_{AC}=1100$ Vp-p, for example, $V_{AC}=1800$ Vp-p, and therefore $$1100=1800\times C/(C+120) \quad (5)$$

Therefore C is set to be 189 (pF).

For the DC component of the developing bias V, Z=R, Z2=R2, (because $\omega=0$), and therefore the DC component $V2_{DC}$ of the developing bias voltage V2 of the second developing device is $$V2_{DC}=R2\cdot V_{DC}/(R+R2) \quad (6)$$

In order that $V2_{DC}=-450$ V, $V_{DC}=-500$ V, and therefore $$-450=100\times(-500)/(R+100)$$

$$R\simeq 10\ (M\Omega)$$

Thus, in this embodiment, the developing bias voltage applied to the second developing device 14 is set to be a desired level by connecting into the developing device 14 in series the impedance circuit EC comprising parallel connected electrostatic capacitor C =189 (pF) and a resistor R=10 MΩ.

Figure 15:
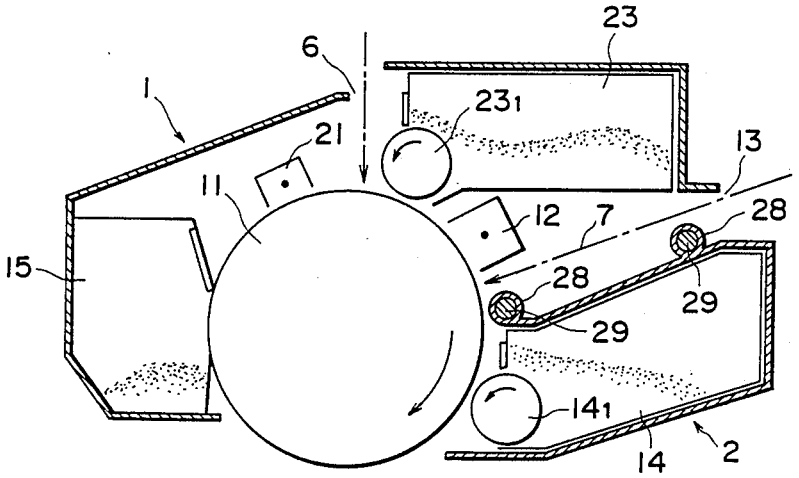
FIG. 15 is a longitudinal section of a process cartridge according to an embodiment of the present invention.

Referring to FIG. 15, there is shown a longitudinal sectional view of a process cartridge according to a further embodiment of the present invention.

In this embodiment, the first developing device 23 is contained in the main cartridge 1, whereas the second developing device 14 is contained in the subordinate cartridge 2. The other structures are the similar to those of the previous embodiment.

The subordinate cartridge 2 is detachably mountable to the main cartridge 1 by, for example, mounting rings 28 formed on the top of the subordinate cartridge 2 being mounted to shafts of the main cartridge 1.

A two color image is formed by the same operation as with FIG. 11 embodiment. In this embodiment, the first developing device 23 is a magnetic brush development type wherein a two-component developer is used which contains a black toner and magnetic particles of ferrite or the like. However, a so-called jumping developing device is usable which uses a one component magnetic toner. The second developing device 14 in this embodiment is of two-component non-contact type wherein a magnetic brush is formed by a two-component developer containing chromatic color toner (red, for example) and magnetic particles of ferrite or the like, and the magnetic brush is opposed to the photosensitive drum 1 without contact thereto. However, the types of the developing devices are not limited to those.

Further, in this embodiment, similarly to the case of FIG. 12 embodiment, the developing bias source and the connector may be commonly used for the developing devices 23 and 14.

It should be noted that the present invention is applicable to the case wherein three or more color image forming apparatus using two or more developing devices.

As described above, according to this embodiment, the image forming condition such as the latent image forming condition and the developing condition is changed depending on whether the subordinate cartridge 2 is mounted or dismounted, so that good images can be produced in both cases. As for the latent image forming condition, exposure amount or the like as well as the charging amount may be changed. As for the developing condition, a distance between the photosensitive drum and the developer carrying member (developing sleeve) as well as the developing bias may be changed.

Further, it is possible to print two pieces of information even when the subordinate cartridge is dismounted, if the structure is such that when the subordinate cartridge is dismounted, the signal is switched so that the information to be printed by the subordinate cartridge is simultaneously printed by the process cartridge.

The toner contained in the developing device 23 of the subordinate cartridge is a chromatic toner in this embodiment, and the properties of the toners are different if the colors are different; and therefore, the development properties are to be different. It follows that it is required to use different bias voltages applied when a developing device containing red toner is used and when a developing device containing blue toner is used. In such a case, it is possible to change the developing bias voltage so as to supply proper bias voltages to the respective developing devices of the subordinate cartridges.

The description will be made as to the mounting and positioning of the subordinate cartridge to the main cartridge (process cartridge). In this embodiment, the structure of the cartridge is as described in conjunction with FIG. 10.

In this embodiment, when the subordinate cartridge containing the developing means (developing device) is mounted to or dismounted from the main cartridge, more particularly when the subordinate cartridge is dismounted, the pressure to the developing device of the subordinate cartridge is released by opening a cover member of the main cartridge to allow the subordinate cartridge to be taken out without difficulty.

When the subordinate cartridge is mounted, it is inserted into the main cartridge through an open position by opening the cover member, and subsequently the cover member is closed, by which the developing means of the subordinate cartridge is pressed and held by a pressing means at a predetermined positional relation with respective to the latent image bearing member of the main cartridge, thus providing an operative mounted position.

Therefore, the mounting and dismounting operation of the subordinate cartridge with respect to the main cartridge is so simple and easy that users without expert knowledge of the image forming apparatus can manipulate the cartridges without erroneous operation.

Additionally, since the subordinate cartridge is normally accommodated in the main cartridge substantially completely, and since the subordinate cartridge is protected by the cover member, the operativeness of the cartridges are similar to a single cartridge.

EXAMPLE 1 (FIGS. 16–21)

Figure 20:
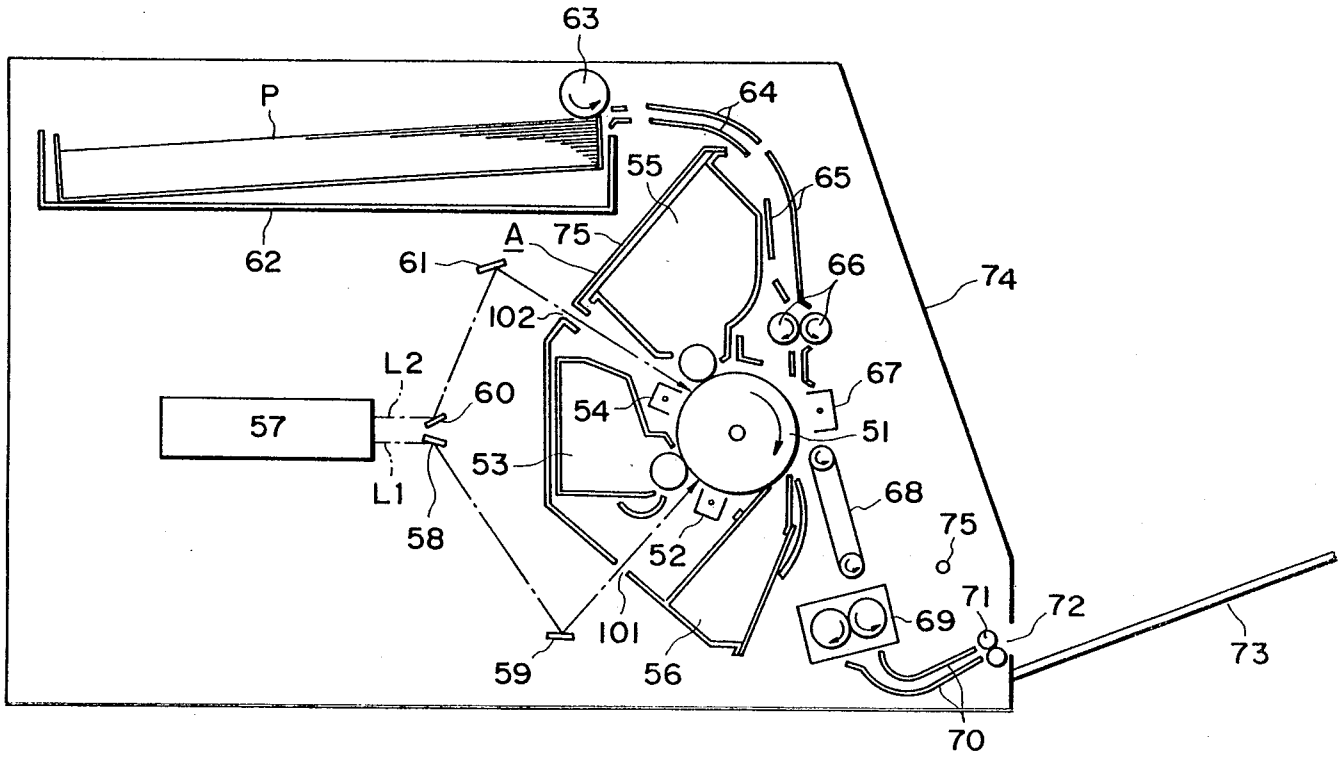
FIGS. 20 and 21 are sectional views of an image forming apparatus wherein the process cartridge is in the image forming apparatus in FIG. 20, whereas the process cartridge is out of the apparatus in FIG. 21.

Referring to FIG. 20, there is shown an example of a two-color laser beam printer (LBP) using the cartridge assembly constructed in accordance with the present invention.

(1) Operation of the printer

A process cartridge A is mounted in the main assembly of the printer at a predetermined position and in a predetermined pose. The cartridge A of this embodiment contains a photosensitive drum 51, a first charger 52, a color developing device 53, a second charger 54, a black developing device 55 and a cleaning device 56, that is, it contains six process means. Of these six process means, five process means 51, 52, 54, 55 and 56 are contained in the main cartridge, whereas the color developing device 53 is contained in the subordinate cartridge which is detachably mountable to the main cartridge, which will be described in more detail hereinafter.

Upon generation of a print start signal, the photosensitive drum 51 is rotated at a predetermined peripheral speed in the direction indicated by an arrow, that is, the clockwise direction. The surface thereof is uniformly charged by a first charger 52, then, is scanningly exposed to a laser beam L1 corresponding to a first image information signal, produced from a laser scanner 57 by way of mirrors 58 and 59 and through a first slit 101 formed in the cartridge housing 75. By this operation, an electrostatic latent image is formed on a surface of the rotating photosensitive drum 1 in accordance with the first image information signal, and the latent image is developed by the color developing device 53 containing red toner, for example.

Then, the surface of the photosensitive drum 1 is again uniformly charged by the second charger 54, and is scanningly exposed to a laser beam L2 corresponding to a second image information signal, produced from a laser scanner 57 by way of mirrors 60 and 61 through a second slit 102 formed in the cartridge housing 75. By this, an electrostatic latent image is formed in accordance with the second image information signal. The latent image is developed by the black developing device 55 with black toner.

In this manner, on the rotating photosensitive drum 51 surface, a color toner developed image corresponding to the first image information signal and a black toner developed image corresponding to the second image information signal are formed.

On the other hand, transfer sheets P is fed out one by one from a sheet cassette 62 by a feeding roller 63. The transfer sheet P is conveyed to a registration roller couple 66 by way of guiding plate 64 and 65. The transfer sheet P is timed with an image on the photosensitive drum 1 by the registration roller couple 66 and is supplied to an image transfer station where the photosensitive drum 51 and the transfer charger 67 are opposed. In the transfer station, the two color toner image on the photosensitive drum 1 surface is transferred onto the transfer sheet P.

The transfer sheet P passed through the image transfer station is separated from the photosensitive drum 1 surface and is introduced by a conveying device 68 into an image fixing device 69 where the transferred toner image is fixed. The sheet P is then discharged through the guiding plate 70, a discharging roller couple 71 and a discharge outlet 72 onto a discharge tray 73 as a two-color print.

The surface of the photosensitive drum 1 after the image transfer is cleaned by the cleaning device so that the remaining toner and other foreign matter are removed so as to be prepared for the repeated image forming operation.

Figure 21:
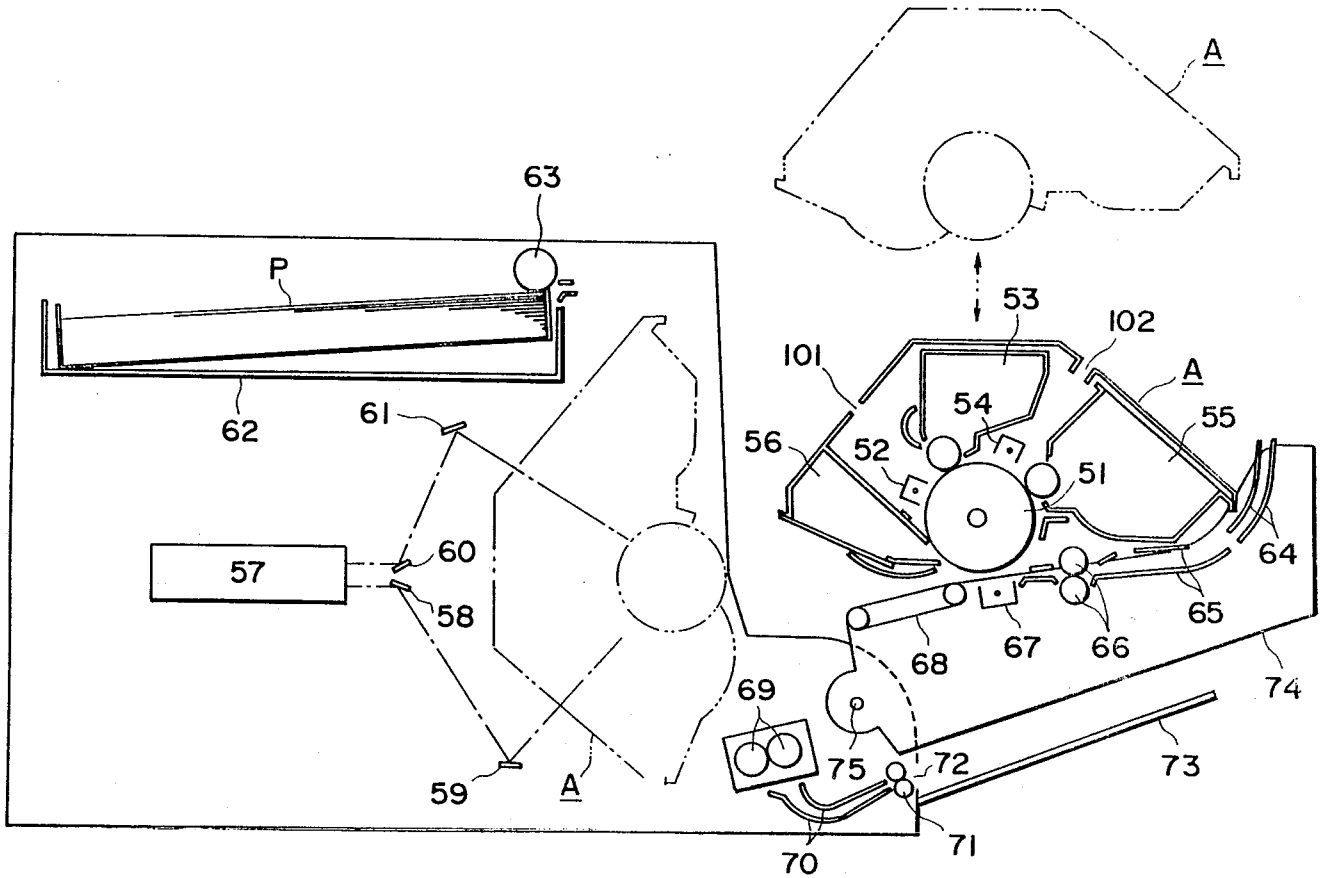

In FIG. 20, the right side of the printer as viewed in this Figure is a front side whereat a front housing plate 74 is provided. The front plate 74 is swingable about a hinge adjacent the bottom of the printer as shown in FIG. 21 with respect to the main assembly of the printer when an unshown locking means is released. On the inside of the front plate 74, guide plates 64 and 65, a registration roller couple 66, a transfer charger 67 and a conveying device 68 are mounted, and therefore, the inside of the printer is significantly opened by opening downwardly the front plate 84 of the printer.

When the cartridge A is mounted into the printer, the front plate 74 is opened, and the cartridge A is mounted on the facing up inside of the front plate 74 at a predetermined position in a predetermined pose by an unshown locking means. The front plate 74 is closed to the main assembly of the printer, and is locked thereto by locking means, by which the cartridge A is mounted at a predetermined position in a predetermined pose in the main assembly of the printer as shown in FIG. 20. When the cartridge A is to be taken out, the reverse operation is performed.

(2) Process cartridge A (FIGS. 16–19)

Figure 16:
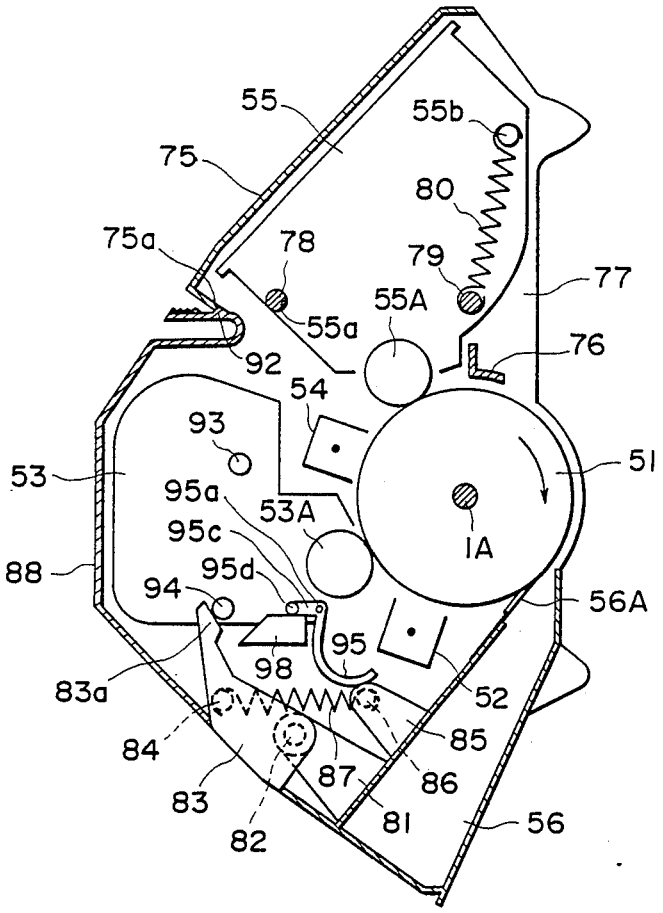
FIG. 16 shows a longitudinal section of a process cartridge illustrating the mounting of the subordinate cartridge.
Figure 17:
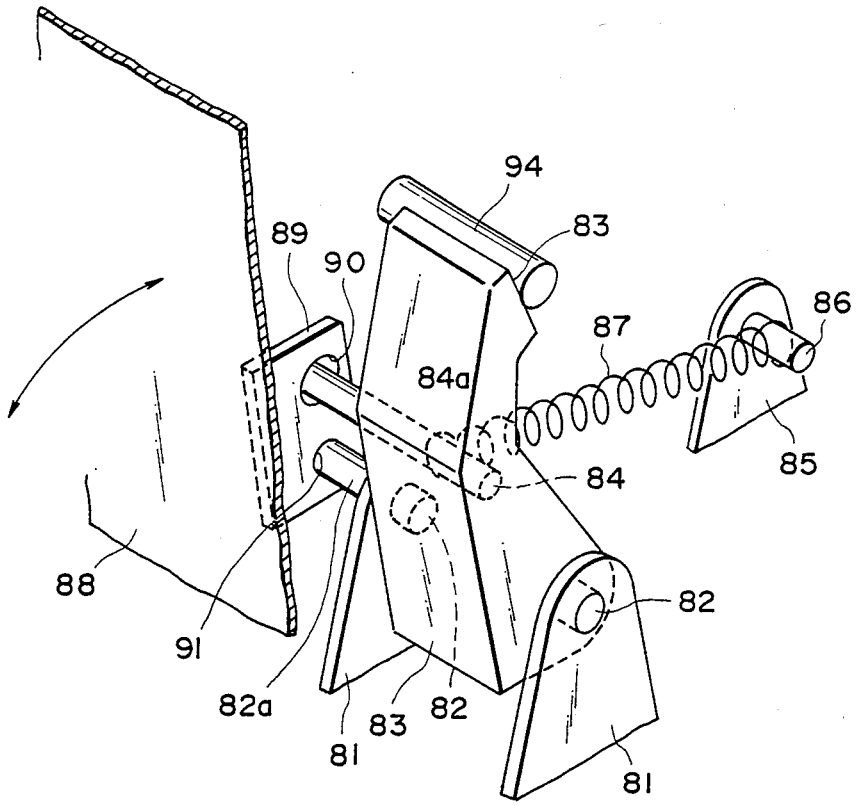
FIG. 17 is a partial perspective view of a door mechanism.
Figure 18:
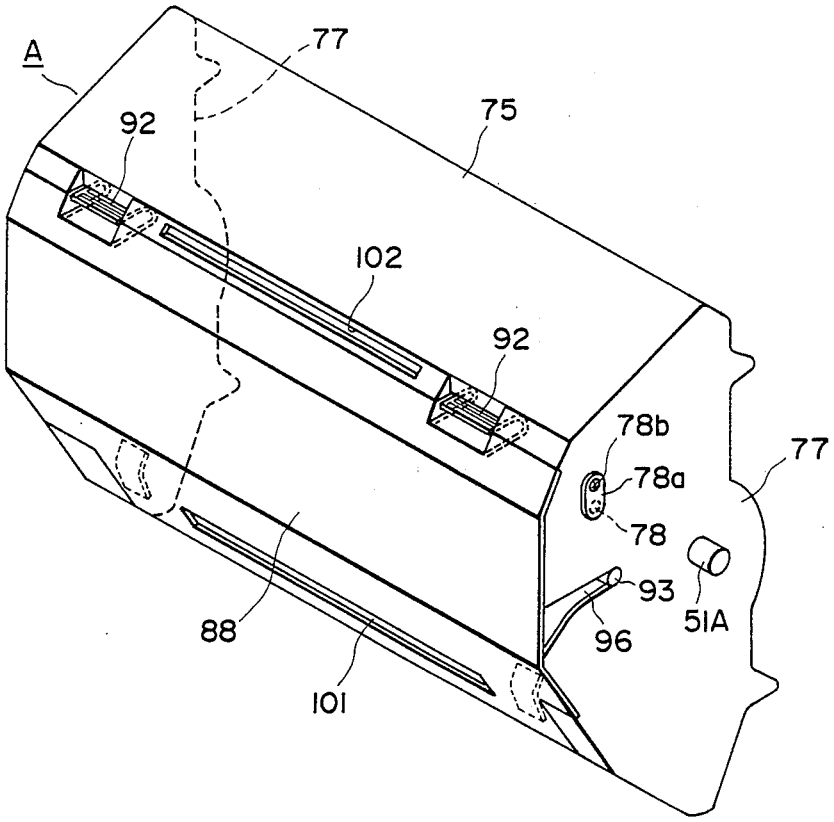
FIG. 18 is a perspective view of a cartridge.
Figure 19:
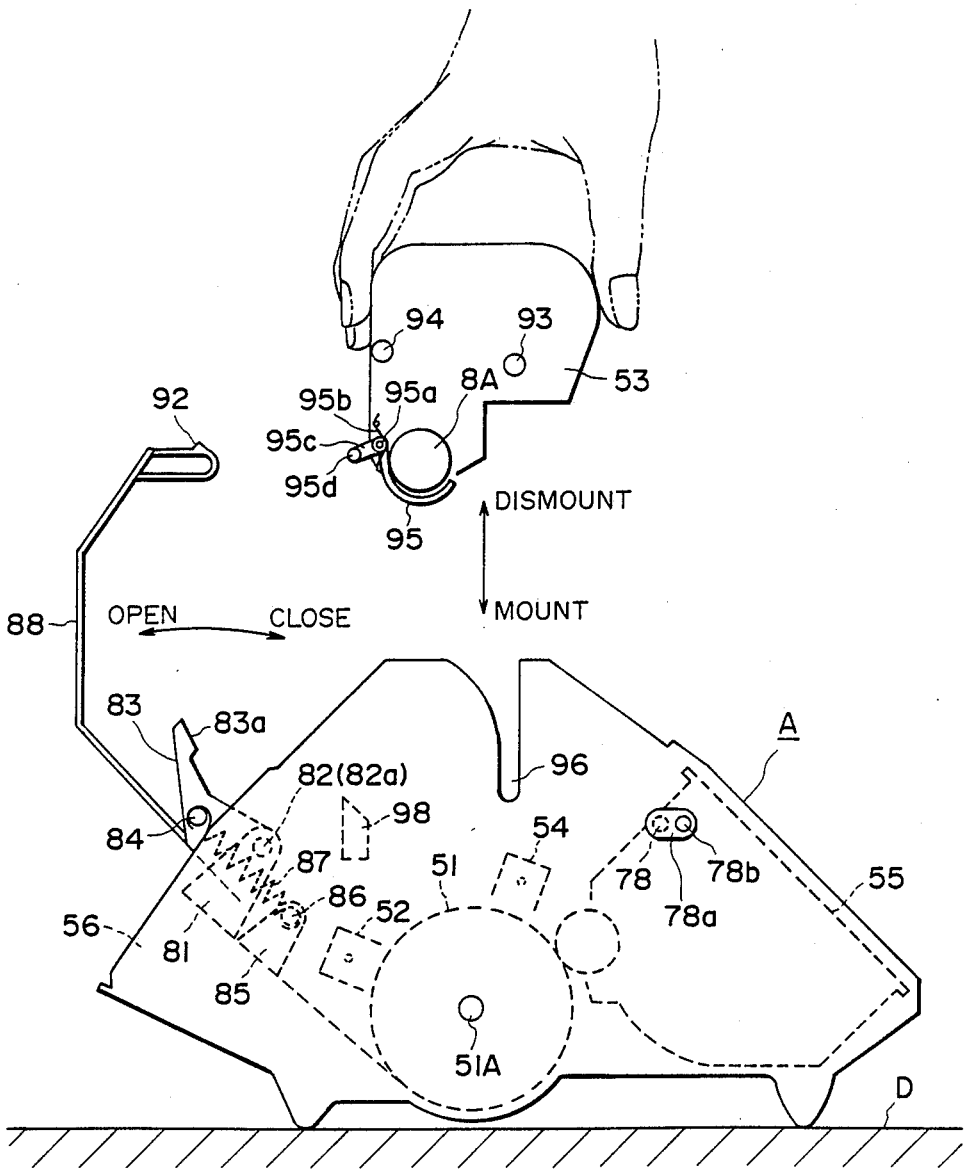
FIG. 19 is a side view of the process cartridge illustrating mounting and dismounting of the subordinate cartridge.

FIG. 16 is a sectional view of a main part of the cartridge A. FIG. 17 is a perspective view of a pressure mechanism. FIG. 18 is a outer perspective view of the process cartridge A. FIG. 19 illustrates the mounting and dismounting of the subordinate cartridge.

The process cartridge A contains six process means, i.e. a photosensitive drum 51, a first charger 52, a color developing device 53, a second charger 54, a black developing device 55 and a cleaning device 56. Of these six process means, five process means except the color developing device 53, i.e., process means 51, 52, 54, 55 and 56 are contained in the main cartridge, whereas the color developing device 53 is contained in the subordinate cartridge detachably mountable to the main cartridge.

As best seen in FIG. 16, the main cartridge includes a housing 75 and a reinforcing stay. In the housing 75, the photosensitive drum 51, the first charger 52, the second charger 54, the black developing device 55 and the cleaning device 56 are mounted in a predetermined relative positional relationship.

The photosensitive drum 51 has a central shaft 51A which is journaled on the left and right side plates 77 and 77 of the housing 75. The first and second chargers 52 and 54 are mounted on an unshown stationary member.

The black developing device 55 has side plates which is provided with holes **55*a* at predetermined symmetrical positions. Correspondingly, housing 75 has side plates 77 which are provided with holes. Supporting pins 78 are inserted into the holes 55*a* of the developing device 55 and the housing 75, and the supporting pin 78 is fixed on the outer surface of the housing side plate by fixing a supporting plate 78*a* (FIG. 18) integral with the supporting pin 78 by screws. Therefore, the black developing device 55 is swingably supported about the supporting pins 78 between the side plates 77 and 77 of the housing 75. Pins 55*b* is mounted at predetermined symmetrical positions on the side plates of the black developing device 55, whereas pins 79 are mounted at predetermined symmetrical positions on the insides of the side plates 77 and 77 of the housing 75. Between the pins 55*b* and 79 a spring 80 is stretched, so that the black developing device 55 is normally urged in the clockwise direction in FIG. 16 about the supporting pin 78 by the tension spring. The developing sleeve 55A or spacer rollers (not shown) at opposite sides thereof are normally press-contacted to the photosensitive drum 51** at a predetermined pressure.

The cleaning device 56 includes a cleaning blade 56A, and an edge thereof is press-contacted normally to the surface of the photosensitive drum 1.

The cleaning device 56 includes a pressing arm base 81 fixedly mounted to a stationary member such as an outer surface of a partition wall of the cleaning device 56, a pressing arm 83 mounted for rotation about a shaft 82 on the pressing arm base 81, a support 85 fixedly mounted to a stationary member such as an outer surface of the partition wall of the cleaning device 56, a pressure applying spring 87 stretched between a pin 86 supported on the support 85 and a pin 84 on a pressure applying arm 83. The pressure applying arm mechanism including the members 81–87 are provided on the respective sides of the housing 75.

The cartridge is provided with a cartridge cover 88 constituting a part of the cartridge housing 75 to protect the subordinate cartridge mounted therein. The cartridge cover 88 and the two pressing arm mechanism are interrelated as shown in FIG. 17. In FIG. 17, a lug 89 is integral with and projecting from a backside of the cover 88, and the lug has two openings 90 and 91 arranged substantially vertically for reception of shafts. A pressing arm base 31 side of the pressing arm shaft 82 is extended and is inserted into the lower opening 91 of the lug 89 at the cover 88 side so that the extension **82*a* thereof is received by the opening 91. The cover 88 is rotatable about the extended portion 82*a* of the shaft. The spring supporting pin 84 is also extended at the pressing arm 83 side, and the extended portion 84*a* is received by the upper opening 90 of the lug 89 at the cover 88 side. The opening 90 has a diameter larger than that of the extended portion 84*a*** inserted therein.

Referring to FIG. 16, at an upper portion of the cover 88 there is provided a resilient locking pawl, which is resiliently engageable with an edge of the opening **75*a* of the cartridge housing 75 to lock the cover at closed state in FIGS. 16 and 18. By flexing the locking pawl 92 against its resiliency to disengage it from the opening edge 75*a*, the cover 78 is allowed to be opened by rotating about a shaft 82*a* (FIG. 19**).

The color developing device 53 functioning as a subordinate cartridge is provided on its lateral sides with symmetrically arranged guiding pins 93 and pressure receiving pins. A shutter plate 95 functioning as a cover member for protecting an exposed part of the developing sleeve 53A (the portion to be opposed to the photosensitive member 51) is provided. The shutter plate 95 is rotatable about a shaft **95*a* toward and away from the exposed surface of the developing sleeve 53*a*, and is normally urged toward the closing position by an urging spring 95*b* (FIG. 19). A shutter lever 95*c* is integral with the shutter plate 95, and an outwardly projecting pin 95*d* is integral with the lever 95*c***.

Reference numeral 96 (FIGS. 18 and 19) designates a guiding groove for guiding the subordinate cartridge which is being mounted or dismounted, the guiding groove is formed in each of the side plate of the housing 75 of the main cartridge. The guide grooves guide the guiding pins 93 of the cover developing device 53.

Reference numeral 98 (FIG. 16) designates cam members mounted at inside surfaces of the side plates 77 and 77 of the housing 75 of the main cartridge at symmetrical positions. To the cam members, the pins **95*d* of the shutter levers 95*c* of the color developing device 53** correspond.

(3) Mounting and dismounting operation of the subordinate cartridge

FIG. 16 shows state where a color developing device 53 has the subordinate cartridge is regularly mounted in the main cartridge.

In this state, the cover 88 is sufficiently closed, and the closed state is stably maintained by the engagement between the opening edge 75*a* and the locking pawl 92.

The guiding pin 93 of the developing device 53 is in engagement with the guiding groove 96 of the main cartridge (FIG. 18).

The shutter plate 95 is sufficiently opened downwardly from the front side of the developing sleeve 53A and is maintained at the released position by the pin 95*d* of the shutter lever 95*c* riding on the top surface of the cam member 98 and the lever 95*c* being rotated in the clockwise direction about the shutter 95*a* against the spring 95*b*.

Next, the cover 88 (FIG. 19) then opened is rotated in the closing direction against the pressure by the spring 87 at the initial stage. During the rotating process, the spring 87 moves upwardly beyond the position of the rotational shaft 82 of the pressing arm 83, then the tension force of the spring 87 applies to the pressing arm 83 a positive rotational urging force about the shaft 82 in the clockwise direction, so that the cover 88 automatically rotates in the closing direction together with the pressing arm 83. The end surface 83*a* of the pressing arm 83 abuts a pressure receiving pin 94 of the color developing device 53 to press the pin 94. Thus, the inserted color developing device 53 is pressed and urged toward the photosensitive drum 1, so that the developing sleeve 53*a* or spacer rollers at the longitudinal ends thereof of the color developing device 54 are press-contacted to the photosensitive drum 51.

Next, the locking pawl 92 of the cover 88 is lightly pushed to be engaged with the edge 75*a* of the opening. By this, the mounting of the subordinate cartridge 53 is completed so that the cartridge A is situated in the manner shown in FIG. 16.

When the subordinate cartridge 53 is mounted to the main cartridge (FIGS. 16 and 17), the shaft 84*a* (FIG. 17) of the pressing mechanism side is not contacted to the hole 90 of the cover 88 with which it is engaged (the diameter of the hole 90 is larger than the diameter of the shaft 84*a*). Therefore, the force by the pressing spring 87 all functions to press the color developing device 53 as the subordinate cartridge. For this reason, the cover 88 is not deformed by the spring force of spring 87 being transmitted to the cover 88, and the lock releasing of the cover 88 is not obstructed.

In the state where the subordinate cartridge 53 is mounted to the main cartridge, the distance between the inside surfaces of the side plates 77 and 77 of the main cartridge housing 75 and the distance between the base portions of the guiding pins 93 (93) of the color developing device 53 as the subordinate cartridge are substantially the same, and therefore, the subordinate cartridge 53 is stably retained without significant play in the longitudinal direction of the photosensitive drum 51.

According to this embodiment, the process cartridge A is such that the subordinate cartridge 53 can be taken out only by opening the cover 88. When the subordinate cartridge 53 is mounted, it will suffice if the subordinate cartridge 53 is inserted into the main cartridge along the guiding groove 96, and then the cover 88 is closed. By doing so, the subordinate cartridge 53 is correctly positioned and retained with pressure. Therefore, the mounting and dismounting of the subordinate cartridge 53 relative to the main cartridge is very simple and easy. Additionally, the subordinate cartridge 53 is accommodated in the main cartridge, so that the manipulation or handling of the cartridge A is almost the same as a known cartridge without the subordinate cartridge, which is used with personal type copying machines.

In response to the mounting and dismounting of the developing device 53 as the subordinate cartridge relative to the main cartridge, the shutter member 95 for protecting the developing device is automatically opened and closed, and therefore, the operator is not required to pay attention to the shutter members without erroneous subordinate cartridge handling.

Since when the subordinate cartridge is taken out, the shutter member is effective to cover a portion which is easily contaminated or a portion which should not be contacted by operator's hands, the subordinate cartridge itself can be easily handled.

Figure 22:
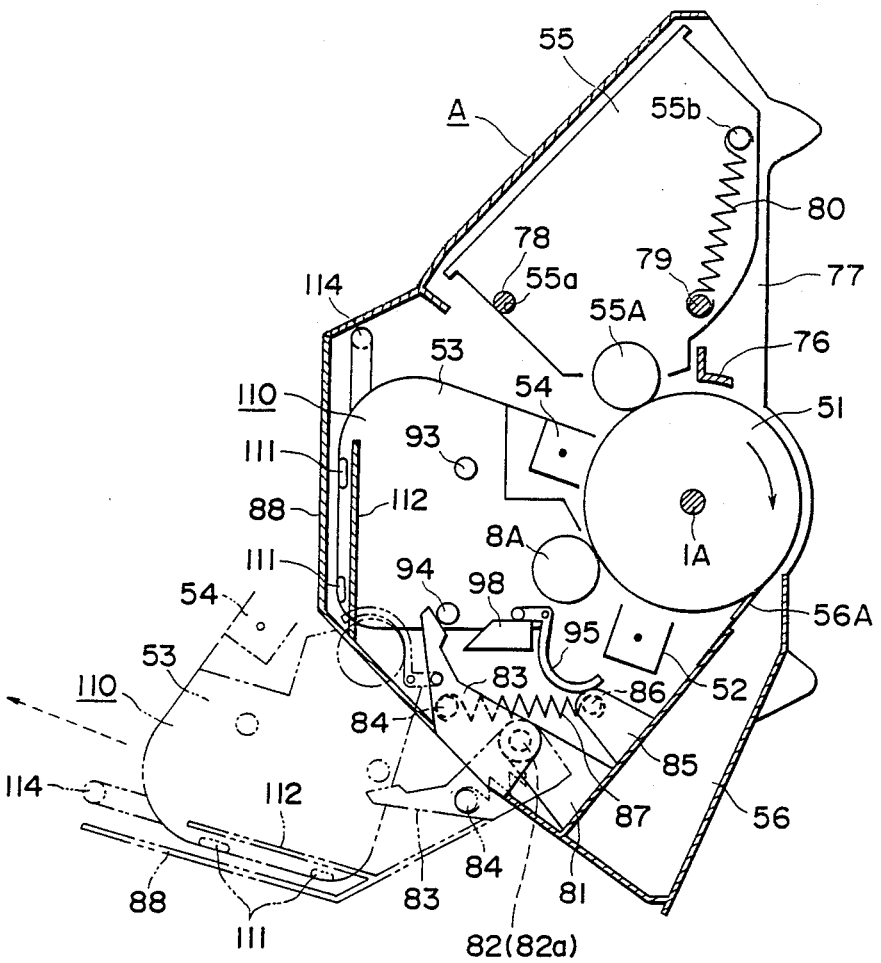
FIG. 22 is a longitudinal sectional view of another process cartridge.
Figure 23:
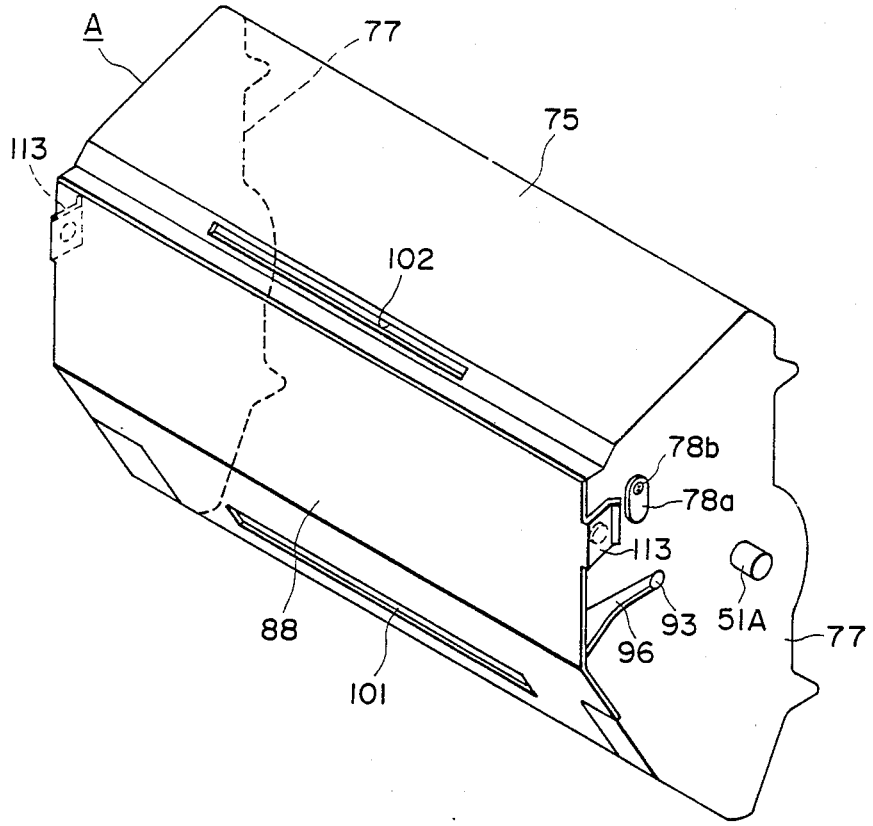
FIG. 23 is a perspective view of FIG. 22 cartridge.
Figure 24:
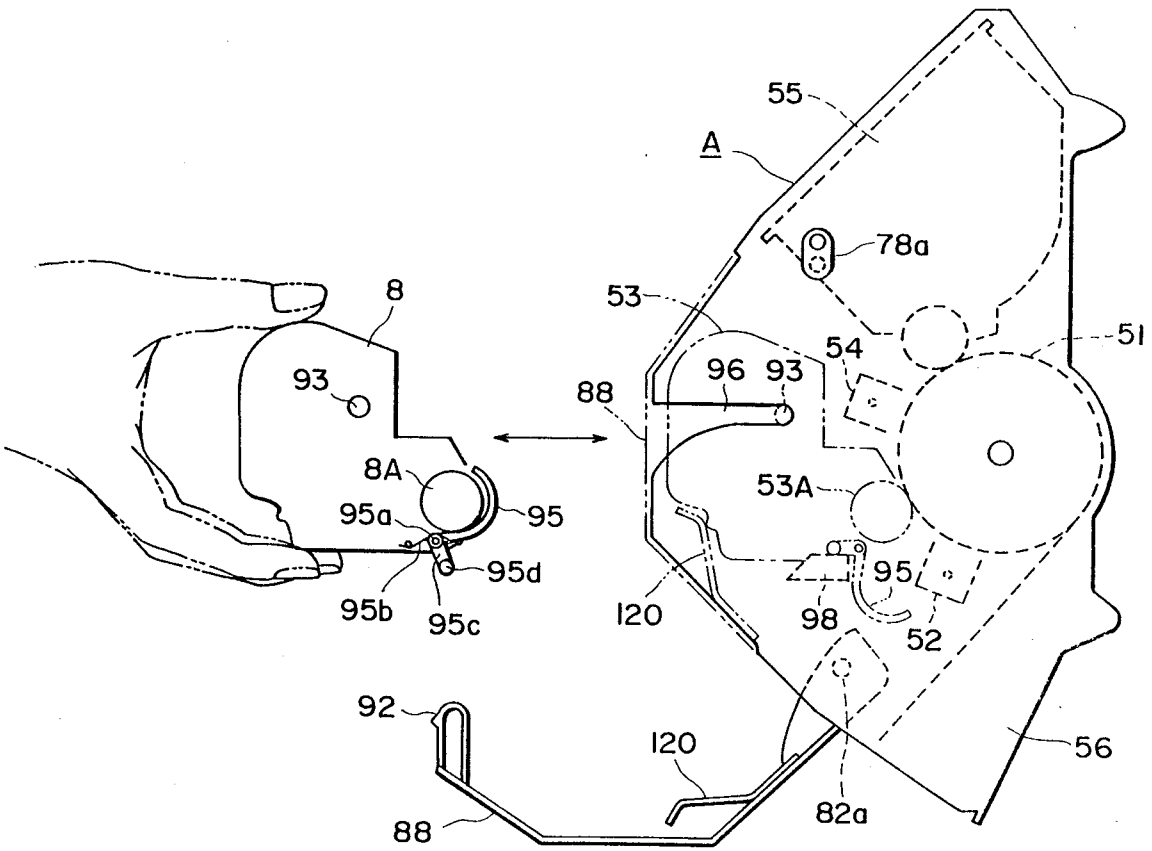
FIG. 24 is a side view of a process cartridge illustrating mounting and dismounting of a subordinate cartridge.

EXAMPLE 2 (FIGS. 22 and 23)

FIG. 22 is a sectional view of a process cartridge A according to another embodiment of the present invention, and FIG. 23 is a perspective view of an external appearance. The detailed description is omitted for the same part as in the foregoing example by assigning the same reference numerals to the corresponding elements.

In this embodiment, a subordinate cartridge 110 contains a color developing device 53 and a second charger 54. The subordinate cartridge is provided with subordinate cartridge guides 111 on outer sides of side plates thereof and with a couple of rails 112 provided on the cover 88. The subordinate cartridge guides 111 are engaged with the rails 112 so as to permit the subordinate cartridge 110 to be mounted on or dismounted from cover 38. At each of the lateral sides of the cover 38, there is provided a side locks 113 (FIG. 23). It is provided in the middle thereof with a projection engageable with holes 77 and 77 of side plates of the cartridge to lock the cover 38 in the closed state. The subordinate cartridge 110 is provided with a grip 114.

Next, the description will be made with respect to the mounting and dismounting of the subordinate cartridge 110. First, the cartridge A is taken out of the main assembly of the printer, and it is put on a desk or the like similarly to the case of FIG. 19. By lightly bending the side lock 113, the cover 88 is released to become openable. When it is opened, the subordinate cartridge 110 rotates about the shaft 82*a* integrally with the cover 38 since the subordinate cartridge guiding rails 111 are engaged with the rails 112. The operator opens the cover 88 against the spring force of the pressing spring 37 at the initial stage. When the spring 87 goes beyond a position where the shafts 86, 82 and 84 are on a line, the pressing arm 83 moves by the pressing spring 87 in the opening direction, so that it is released from the pressing action of the pressing arm 83, automatically.

This is shown by chain lines in FIG. 22. Then, the operator pulls the grip 114 to take the subordinate cartridge 110 in the direction indicated by an arrow.

The subordinate cartridge 110 can be set to the main cartridge by the reverse operations. More particularly, taking the grip 114, the operator inserts the cartridge guides 111 into the rails 112. Then, the cover 38 is closed, by which the subordinate cartridge 110 moves together with the cover 88, and the subordinate cartridge 110 is pressed by the pressing arm 83 and is retained at a predetermined position. When the projection of the side lock 113 is engaged into the hole of the cartridge side plate, the cover 88 is locked. Therefore, according to this embodiment, the mounting and dismounting of the subordinate cartridge 110 is very simple. Also, the manipulation is easy since the subordinate cartridge 110 is taken out or inserted with the subordinate cartridge 110 being outside of the main cartridge, and since the subordinate cartridge 110 moves together with the cover 88.

When the subordinate cartridge 110 is exchanged with a new one, the second charger 54 is also exchanged simultaneously, the charging operation is always stabilized and assured.

EXAMPLE 3 (FIG. 24)

Since this embodiment is similar to FIG. 16 embodiment, the detailed description will be omitted for the same elements by assigning the same reference numerals thereto.

A pressing leaf spring 120 is fixed about the center of the cover 88. With the closed state of the cover 88, the pressing leaf spring 120 pushes a back side of the cover developing device 53 as the subordinate cartridge as shown by chain lines, and the developing sleeve 53A is press-contacted to the photosensitive drum 51 with a predetermined pressure. The leaf spring 120 is mounted adjacent the center of the cover 88, so that it pushes the substantial center of the subordinate cartridge 53, whereby it is pushed substantially uniformly along the longitudinal direction of the photosensitive drum 51. Since the pressing mechanism for the subordinate cartridge 53 is simple, the cost thereof can be decreased. For the mounting and dismounting of the subordinate cartridge 53, the operation is similar to the embodiment of FIG. 16, and therefore, the operation is simple and easy.

As described, according to the present invention, multi-color image formation can be performed easily, and the maintenance operation is easy, whereby multicolor image can be always stably provided.

Since the subordinate process cartridge is detachably mountable to the main process cartridge, whereby the color or developing property can be changed by exchanging the subordinate cartridge. Further, the maintenance of the cartridge can be separately performed for the main and subordinate cartridges, so that it is economical in the maintenance operation.

When the image forming condition of the process cartridges is to be changed, it is performed automatically in response to the mounting and dismounting of the subordinate cartridge, and therefore, the quality of the image can be maintained.

While the invention has been described with reference to the structures disclosed herein, it is not confined to the details set forth and this application is intended to cover such modifications or changes as may come within the purposes of the improvements or the scope of the following claims.

What is claimed is:

1. A main process cartridge detachably mountable to a main assembly of an image forming apparatus, comprising as a unit:

an image bearing member;

first developing means for developing a latent image formed on said image bearing member;

a supporting member for supporting said image bearing member and said first developing means as a unit; and a mounting portion, on said supporting member, for detachably mounting to said main process cartridge a subordinate cartridge separate from said main process cartridge and containing second developing means, separate from said first developing means, for developing a latent image formed on said image bearing member.

2. A process cartridge according to claim 1, wherein said main cartridge contains said image bearing member which is an electrophotographic photosensitive member, said first developing means, a charger for charging said electrophotographic photosensitive member and cleaning means for removing residual toner particles from said photosensitive member.

3. A process cartridge according to claim 1, wherein said subordinate cartridge contains said second developing means and a corona discharger as a unit.

4. A process cartridge according to claim 1, wherein said first and second developing means contain toners which are different in color.

5. A process cartridge according to claim 1, wherein said first developing means contains a black toner.

6. A process cartridge detachably mountable to a main assembly of an image forming apparatus, comprising:

a main process cartridge including an image bearing member, a first developing means for developing a latent image formed on said image bearing member and a supporting member for supporting said image bearing member and said first developing means as a unit;

a subordinate cartridge containing a second developing means for developing a latent image formed on said image bearing member;

said main cartridge including mounting means for detachably mounting to said main process cartridge said subordinate cartridge;

said subordinate cartridge including a portion for mounting said second developing means to said mounting means.

7. A process cartridge according to claim 6, wherein said first and second developing means containing toners which different in color.

8. A process cartridge according to claim 6, wherein said main cartridge contains said image bearing member which is an electrophotographic photosensitive member, said first developing means and cleaning means for removing residual toner from said photosensitive member as a unit.

9. A process cartridge according to claim 8, wherein said mounting portion is between said cleaning means and said first developing means and at such a position where said second developing means is opposed to said photosensitive member.

10. A process cartridge according to claim 6, wherein said mounting means is provided with a cover, and wherein in response to opening and closing of said cover, a locking between said subordinate cartridge and said main cartridge is released or made.

11. A process cartridge according to claim 8, wherein said main process cartridge further contains means for charging said photosensitive member.

12. A process cartridge detachably mountable to a main assembly of an image forming apparatus, comprising:

a main process cartridge including an image bearing member, first developing means for developing an electrostatic latent image formed on said image bearing member and a supporting member for supporting said image bearing member and said first developing means as a unit;

a subordinate process cartridge containing second developing means for developing a latent image formed on said image bearing member;

said main process cartridge including mounting means for detachably mounting to said main process cartridge said subordinate cartridge;

said subordinate cartridge including a portion for mounting said second developing means to said mounting means; and means for automatically setting an image forming condition in association with presence or absence of said subordinate process cartridge.

13. A process cartridge according to claim 12, wherein said main process cartridge contains said image bearing member which is an electrophotographic photosensitive member, said first developing means and cleaning means for removing residual toner from said photosensitive member as a unit.

14. An apparatus according to claim 12, wherein said main process cartridge contains said image bearing member which is an electrophotographic photosensitive member, and wherein the image forming condition under which an image is formed on said photosensitive member is automatically set in response to said setting means.

15. A process cartridge according to claim 14, wherein said subordinate cartridge is provided with said setting means.

16. A process cartridge according to claim 13, wherein said main process cartridge further contains means for charging said photosensitive member.

17. A process cartridge detachably mountable to a main assembly of an image forming apparatus, comprising:

an image bearing member;

first developing means for developing a latent image formed on said image bearing member;

a supporting member for supporting said image bearing member and said first developing means as a unit;

mounting means for detachably mounting to said process cartridge a subordinate cartridge; and a cover for covering said image bearing member, said first developing means and said subordinate cartridge, said cover being provided with an opening for introducing first and second image information light to said image bearing member.

18. A process cartridge according to claim 17, wherein said cover is provided with a second opening, and wherein said first and second openings are disposed upstream and downstream of said mounting means, respectively with respect to movement direction of said image bearing member.

19. A process cartridge according to claim 17, wherein said information light includes light beams which correspond to image signals.

20. A subordinate process cartridge detachably mountable to a main process cartridge, comprising:

developing means for developing a latent image formed on an image bearing member contained in the main process cartridge, said main process cartridge also containing another developing means for developing a latent image formed on said image bearing member; and means for positioning said subordinate process cartridge relative to said main process cartridge.

21. A process cartridge according to claim 20, further comprising means for charging said image bearing member.

22. A process cartridge according to claim 21, further comprising means for automatically setting an image forming condition of said process cartridge.

23. An image forming apparatus to which a process cartridge is detachably mountable, comprising:

a main process cartridge including an image bearing member, first developing means for developing a latent image formed on said image bearing member, a supporting member for supporting said image bearing member and said first developing means, wherein a subordinate process cartridge containing a second developing means which is separate from said first developing means is detachably mountable to said main process cartridge;

means for supporting said main process cartridge at a predetermined position;

optical means for projecting information light to the image bearing member of said main process cartridge; and means for transferring a toner image from said image bearing member to a transfer material.

24. An apparatus according to claim 23, wherein said supporting means is in a main assembly of said image forming apparatus and in a cartridge supporting assembly which is openable and closable to a part of said main assembly containing said optical means.

25. An apparatus according to claim 24, wherein when said cartridge supporting assembly is opened, said main cartridge is exposed while being supported on said cartridge supporting assembly.

26. An apparatus according to claim 25, wherein said subordinate cartridge is detachably mountable to said main cartridge on said cartridge supporting assembly.

27. An image forming apparatus and according to claim 23, wherein said information light includes light beams which correspond to image signals.

28. An image forming apparatus according to claim 23, wherein a first developed image formed on said image bearing member by said first developing means and a second developed image formed on said image bearing member by said second developing means are transferred onto a transfer material by said transferring means in one step.

29. An image forming apparatus to which a process cartridge is detachably mountable, comprising:

a main process cartridge including an image bearing member, first developing means for developing a latent image formed on said image bearing member, supporting member for supporting said image bearing member and said first developing means as a unit, wherein a subordinate process cartridge containing a second developing means which is separate from said first developing means is detachably mountable to said main process cartridge;

a main assembly for supporting said main process cartridge and openable for allowing said main process cartridge to be taken out;

optical means for projecting information light to the image bearing member of said main process cartridge; and means for transferring a toner image formed on the image bearing member onto a transfer material.

30. A process cartridge according to claim 29, wherein said main process cartridge is supported on a part of said main assembly which is openable.

31. An apparatus according to claim 30, wherein said part of said main assembly supporting said main cartridge supports said main cartridge horizontally when it is opened.

32. An apparatus according to claim 31, wherein said subordinate cartridge is detachably mountable when supported horizontally.

33. An image forming apparatus and according to claim 29, wherein said information light includes light beams which correspond to image signals.

34. An image forming apparatus according to claim 29, wherein a first developed image formed on said image bearing member by said first developing means and a second developed image formed on said image bearing member by said second developing means are transferred onto a transfer material by said transferring means in one step.

35. An image forming apparatus according to claim 31, wherein said part of said main assembly is openable by rotation about a shaft, and wherein upon opening, said main process cartridge rotates from a predetermined position to a position horizontally placed on said part of said main assembly.

36. An image forming apparatus to which a process cartridge is detachably mountable, comprising:

a cartridge including a main process cartridge containing an image bearing member, a first developing means for developing a latent image formed on said image bearing member and supporting means for supporting said image bearing member and said first developing means as a unit, wherein a subordinate process cartridge having a second developing means which is separate from said first developing means is detachably mountable to said main process cartridge;

means for automatically setting an image forming condition depending on absence and presence of said subordinate process cartridge;

a main assembly for supporting said cartridge, said main assembly being dividingly openable to allow said main cartridge to be taken out;

means for projecting information light onto the image bearing member of said cartridge; and means for transferring a toner image formed on said image bearing member onto a transfer material.

37. An apparatus according to claim 36, wherein said setting means is provided in said subordinate cartridge.

38. An image forming apparatus and according to claim 36, wherein said information light includes light beams which correspond to image signals.

39. An image forming apparatus according to claim 36, wherein a first developed image formed on said image bearing member by said first developing means and a second developed image formed on said image bearing member by said second developing means are transferred onto a transfer material by said transferring means in one step.

* * * * *

UNITED STATES PATENT AND TRADEMARK OFFICE

CERTIFICATE OF CORRECTION

PATENT NO. : 4,924,267

DATED : May 8, 1990

INVENTOR(S) : MASAO YOSHIKAWA ET AL.

It is certified that error appears in the above-identified patent and that said Letters Patent is hereby corrected as shown below:

COLUMN 2

Line 60, "cartridge" should read --cartridges--.

COLUMN 4

Line 67, "an" should read --a--.

COLUMN 5

Line 26, "thereto, in" should read --thereto. In--.
Line 61, "device" should read --devices--.

COLUMN 8

Line 43, "first charge 21" should read --first charger 21--.
Line 47, "changing" should read --change--.

COLUMN 9

Line 11, "necessiates to change" should read --necessitates changing--.
Line 31, "first developing device 13" should read --first developing device 23--.
Line 40, "photosensitive drum 1" should read --photosensitive drum 11--.
Line 55, "photosensitive drum 1" should read --photosensitive drum 11--.
Line 64, "device 24." should read --device 23.--.

UNITED STATES PATENT AND TRADEMARK OFFICE

CERTIFICATE OF CORRECTION

PATENT NO. : 4,924,267

DATED : May 8, 1990

INVENTOR(S) : MASAO YOSHIKAWA ET AL.

It is certified that error appears in the above-identified patent and that said Letters Patent is hereby corrected as shown below:

COLUMN 10

Line 49, "an" should read --and--.

COLUMN 11

Line 8, "supplied" should read --is supplied--.
Line 15, "conditions" should read --condition--.
Line 62, "$W^2R^2C^2$" should read --$w^2R^2C^2$--.

COLUMN 12

Line 33, "the similar" should read --similar--.
Line 52, "photosensitive drum 1" should read --photosensitive drum 11-.

COLUMN 13

Line 44, "respective" should read --respect--.

COLUMN 14

Line 42, "guiding plate 64 and 65." should read --guiding plates 64 and 65.--.

COLUMN 15

Line 15, "front plate 84" should read --front plate 74--.
Line 21, "a" should read --an--.
Line 47, "is" should read --are--.
Line 57, "is" should read --are--.

UNITED STATES PATENT AND TRADEMARK OFFICE

CERTIFICATE OF CORRECTION

PATENT NO. : 4,924,267

DATED : May 8, 1990

INVENTOR(S) : MASAO YOSHIKAWA ET AL.

It is certified that error appears in the above-identified patent and that said Letters Patent is hereby corrected as shown below:

COLUMN 16

Line 19, "mechanism" should read --mechanisms--.
Line 24, "pressing arm base 31" should read --pressing arm base 81--.
Line 62, "cover developing device 53." should read --color developing device 53.--.

COLUMN 17

Line 5, "is" should be deleted.
Line 35, "color developing device 54" should read --color developing device 53--.

COLUMN 18

Line 38, "cover 38." should read --cover 88.--.
Line 39, "38," should read --88,--.
Line 42, "cover 38" should read --cover 88--.
Line 51, "cover 38" should read --cover 88--.
Line 55, "37" should read --87--.
Line 66, "cover 38" should read --cover 88--.

COLUMN 19

Line 24, "cover" should read --color--.

COLUMN 20

Line 45, "containing" should read --contain--.
Line 46, "which different" should read --which are different--.

UNITED STATES PATENT AND TRADEMARK OFFICE

CERTIFICATE OF CORRECTION

PATENT NO. : 4,924,267

DATED : May 8, 1990

INVENTOR(S) : MASAO YOSHIKAWA ET AL.

It is certified that error appears in the above-identified patent and that said Letters Patent is hereby corrected as shown below:

COLUMN 22

Line 41, "and" should be deleted.

COLUMN 23

Line 13, "and" should be deleted.

COLUMN 24

Line 10, "and" should read --or--.
Line 21, "and" should be deleted.

Signed and Sealed this

Fifth Day of January, 1993

*Attest:*

DOUGLAS B. COMER

*Attesting Officer*

*Acting Commissioner of Patents and Trademarks*